US009240277B2

(12) United States Patent
Osawa

(10) Patent No.: US 9,240,277 B2
(45) Date of Patent: Jan. 19, 2016

(54) APPARATUS AND METHOD FOR MANUFACTURING NON-CIRCULAR COIL

(71) Applicant: NITTOKU ENGINEERING CO., LTD., Saitama-shi, Saitama (JP)

(72) Inventor: Masumi Osawa, Fukushima (JP)

(73) Assignee: NITTOKU ENGINEERING CO., LTD., Saitama (JP)

( * ) Notice: Subject to any disclaimer, the term of this patent is extended or adjusted under 35 U.S.C. 154(b) by 103 days.

(21) Appl. No.: 13/926,196

(22) Filed: Jun. 25, 2013

(65) Prior Publication Data

US 2013/0341454 A1 Dec. 26, 2013

(30) Foreign Application Priority Data

Jun. 26, 2012 (JP) ..... 2012-142758

(51) Int. Cl.
*B21F 3/04* (2006.01)
*H01F 41/06* (2006.01)

(52) U.S. Cl.
CPC ..... *H01F 41/0654* (2013.01); *H01F 41/0633* (2013.01)

(58) Field of Classification Search
CPC ..... H02K 41/02; H02K 41/0612; H02K 41/0641; H02K 41/0654; H02K 41/067
USPC ..... 242/431, 437, 440.1, 445.1, 448
See application file for complete search history.

(56) References Cited

U.S. PATENT DOCUMENTS 3,672,040 A * 6/1972 Arnold ..... 29/596
5,076,508 A * 12/1991 Arnold et al. ..... 140/92.2
7,311,284 B2 * 12/2007 Hashimoto et al. ..... 242/437.1
2005/0133655 A1 6/2005 Hashimoto et al.
2008/0001016 A1 1/2008 Nierlich
2009/0090807 A1 4/2009 Nomura et al.

FOREIGN PATENT DOCUMENTS

JP 9-148168 A 6/1997
JP 2008-511150 A 4/2008
JP 2008-244472 A 10/2008
JP 2009-049357 A 3/2009
JP 20104589 A 1/2010
JP 20124483 A 1/2012
TW 200811024 A 3/2008

OTHER PUBLICATIONS

Extended European Search Report issued Sep. 9, 2014, corresponding European patent application No. 13173523.5.
Office Action issued May 29, 2014, corresponds to Taiwanese patent application No. 102122339.
Office Action dated Jul. 21, 2015, corresponding to Chinese patent application No. 201310259860.2.

* cited by examiner

*Primary Examiner* — Emmanuel M Marcelo
(74) *Attorney, Agent, or Firm* — Hauptman Ham, LLP

(57) ABSTRACT

An apparatus for manufacturing a non-circular coil, includes a pair of swinging pieces, an operation piece to be inserted and removed from between the distal ends of the pair of swinging pieces to increase or reduce the distance between the distal ends of the pair of swinging pieces, and a winding mechanism for winding a wire around an outer circumference of a distal end of the pair of swinging pieces so as to form a non-circular coil, wherein side surfaces of the operation piece, which avoid contact with the pair of swinging pieces, bulge outward to be curved and are formed so as to be continuous with outer circumferential surfaces of the pair of swinging pieces, around which the wire is wound, in a state in which the operation piece is inserted between the distal ends of the pair of swinging pieces.

12 Claims, 19 Drawing Sheets

APPARATUS AND METHOD FOR MANUFACTURING NON-CIRCULAR COIL

TECHNICAL FIELD

The present invention relates to an apparatus and a method for manufacturing a non-circular coil.

BACKGROUND ART

In a speaker to be used for a small-sized device such as a cellular phone, a circular coil having a relatively small size, which is obtained by winding a relatively thin wire in a circular fashion, is conventionally used. As a method of manufacturing the circular coil described above, a winding apparatus for winding a wire for a coil around a core having a circular cross section is known (JP1997-148168A). In the winding apparatus, the wire wound around the core into a coil shape is removed from the core to obtain the circular coil having a desired diameter.

In recent years, a speaker having an oval or oblong cross section is often used as the speaker to be used for the small-sized devices. For the speaker having the oval or oblong cross section, a non-circular coil having an oblong, oval, or ellipsoidal cross section is used.

SUMMARY OF INVENTION

When the non-circular coil is manufactured by using the conventional winding apparatus, there is required a step of winding the wire around a core having an oblong, oval, or ellipsoidal cross section and removing a coil obtained by winding the wire from the core. In the conventional winding apparatus described above, the wire is wound around the core under a predetermined tension. Therefore, an operation of removing the non-circular coil formed by winding the wire from the core becomes relatively difficult. In order to facilitate the removal of the non-circular coil, a wire guide is used to remove the coil from the core in JP1997-148168A. If the wire guide is brought into abutment against an end of the coil to forcibly remove the coil from the core, however, a predetermined tension is exerted to slide a surface coating of the wire on an inner circumference of the coil against the core. Therefore, there is a fear of damage to the coating.

The core having the oblong or oval cross section has straight-line portions, as illustrated in FIG. 19. FIG. 19 illustrates a cross section of a core 3 having an oval cross section. When a wire 2 is wound around the core 3 having the straight-line portions, a force for pressing the wire 2 against the straight-line portions of the core 3 is not generated even when a predetermined tension F is applied in a longitudinal direction of the wire 2, as indicated by the arrow in solid line. Therefore, when the wire 2 is wound to form a plurality of turns on the straight-line portions, the wire 2 is spaced away from the straight-line portions to bulge as indicated by arrows in broken lines without being held in contact with the straight-line portions of the core 3 by a contact resistance with the adjacent turn of the wire 2. As a result, it becomes difficult to obtain a coil having a desired shape.

It is an object of the present invention to provide an apparatus and a method for manufacturing a non-circular coil, which enable a coil to be relatively easily removed from a core without damaging a coating of a wire.

It is another object of the present invention to provide an apparatus and a method for manufacturing a non-circular coil, which enable a wire to be wound without a bulge to obtain a coil having a desired shape.

According to one aspect of the present invention, an apparatus for manufacturing a non-circular coil, comprises a pair of swinging pieces having base ends supported swingably and distal ends with a distance therebetween being increasable or reducible, an operation piece to be inserted and removed from between the distal ends of the pair of swinging pieces to increase or reduce the distance between the distal ends of the pair of swinging pieces, and a winding mechanism for winding a wire around an outer circumference of a distal end of the pair of swinging pieces with the distance therebetween being enlarged by the insertion of the operation piece so as to form a non-circular coil, wherein side surfaces of the operation piece, which avoid contact with the pair of swinging pieces, bulge outward to be curved and are formed so as to be continuous with outer circumferential surfaces of the pair of swinging pieces, around which the wire is wound, in a state in which the operation piece is inserted between the distal ends of the pair of swinging pieces.

According to another aspect of the present invention, a method of manufacturing a non-circular coil, comprises an enlarging step of inserting an operation piece between distal ends of a pair of swinging pieces having base ends supported swingably and the distal ends with a distance therebetween being increasable or reducible so as to enlarge the distance between the distal ends of the pair of swinging pieces, a winding step of winding a wire around an outer circumference of a distal end of the pair of swinging pieces with the distance therebetween being enlarged by the insertion of the operation piece so as to form a non-circular coil, a reducing step of pulling out the operation piece from between the pair of swinging pieces to reduce the distance between the distal ends of the pair of swinging pieces, around which the non-circular coil is formed, and a coil-removing step of removing the non-circular coil from the reduced outer circumference of the distal end of the pair of swinging pieces, wherein side surfaces of the operation piece, which avoid contact with the pair of swinging pieces, bulge outward to be curved and are formed so as to be continuous with outer circumferential surfaces of the pair of swinging pieces, around which the wire is wound, in a state in which the operation piece is inserted between the distal ends of the pair of swinging pieces.

DESCRIPTION OF EMBODIMENTS

In the following, an embodiment of the present invention is described referring to the accompanying drawings.

An apparatus 10 for manufacturing a non-circular coil (hereinafter also referred to simply as "manufacturing apparatus 10") according to the embodiment of the present invention is used to manufacture a non-circular coil for a voice coil to be used for a small-sized speaker and the like.

Figure 5:
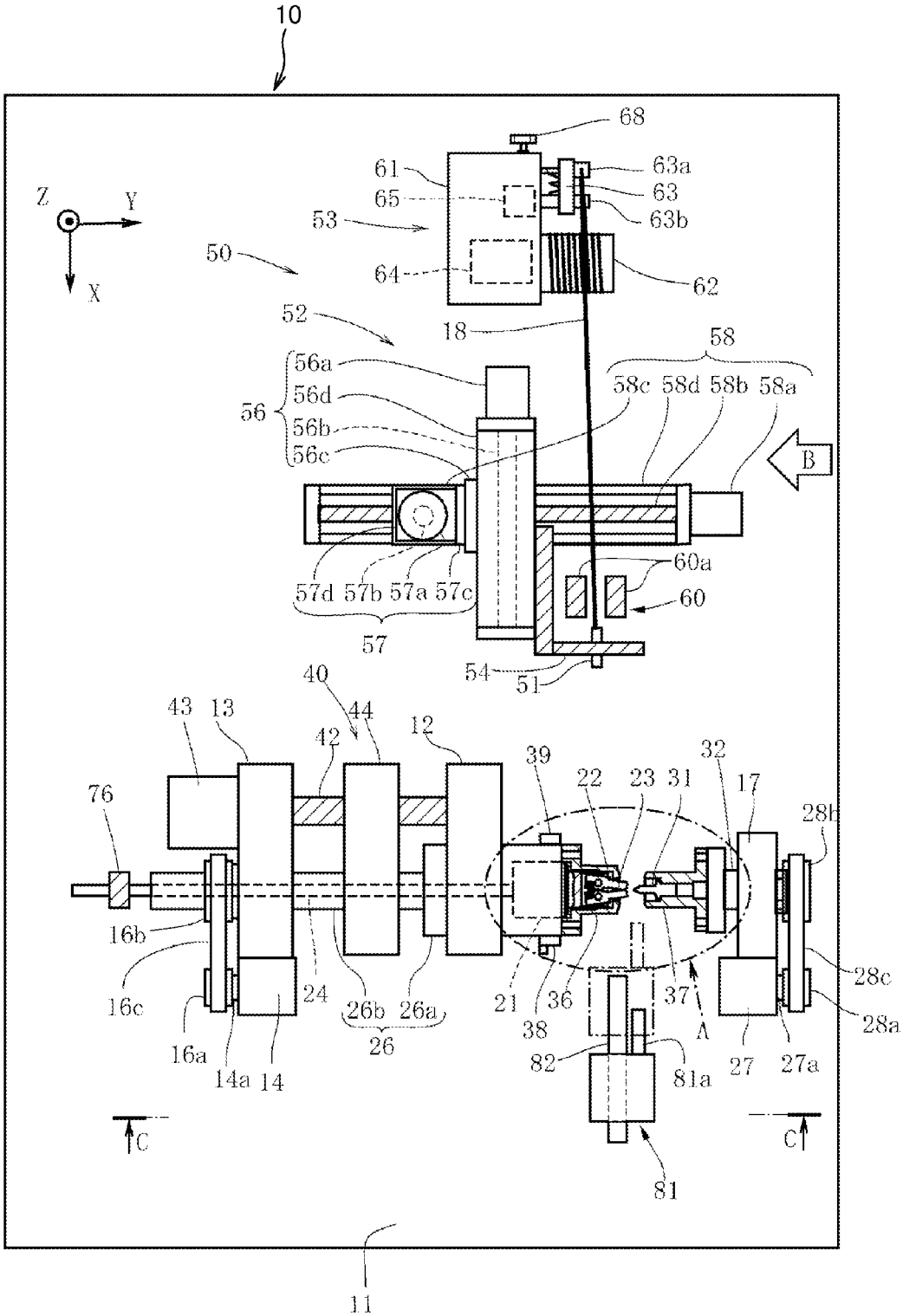
FIG. 5 is a plan view of the apparatus for manufacturing a non-circular coil according to the embodiment of the present invention.

In FIG. 5, three axes, that is, X-, Y-, and Z-axes which perpendicularly cross each other, are set. The X-axis extends in an approximately longitudinal direction in a horizontal plane, the Y-axis extends in an approximately transverse direction in the horizontal plane, and the Z-axis extends in a vertical direction. As illustrated in FIG. 5, a first support wall 12 and a second support wall 13 are provided on a mount 11 of the manufacturing apparatus 10 so as to stand vertically thereon in parallel to each other in the Y-axis direction at a predetermined distance from each other. A first rotary body 26 is provided between the first support wall 12 and the second support wall 13 so as to extend in the Y-axis direction and be movable in the longitudinal direction. The first rotary body 26 includes a large-diameter portion 26*a* and a small-diameter portion 26*b*. The large-diameter portion 26*a* is a bar-like member having a circular cross section, which is movably supported by the first support wall 12. The small-diameter portion 26*b* is a bar-like member having a circular cross section, which is continuously formed coaxially with the large-diameter portion 26*a* and is movably supported by the second support wall 13. A core 24 is provided to the first rotary body 26 so as to pass through a center axis thereof.

The core 24 is a bar-like member having a circular cross section. A base member 21 having a columnar shape is provided to a distal end of the core 24 so as to be coaxial therewith. A concave portion 26*c* (FIG. 4), in which the base member 21 is received, is formed on the large-diameter portion 26*a* of the first rotary body 26. The small-diameter portion 26*b* is formed so as to have a larger outer diameter than that of the core 24 which is provided coaxially with the base member 21. The core 24 is spline-coupled to the first rotary body 26, and is movable in the longitudinal direction relative to the first rotary body 26. At the same time, the core 24 passes through the first rotary body 26 so as not to be rotatable relative to the first rotary body 26. A pair of swinging pieces 22 and 23 is supported by the base member 21 so that the swinging piece 22 is swingable about a shaft 22*a* and the swinging piece 23 is swingable about a shaft 23*a*. The shafts 22*a* and 23*a* are provided on a base end side. The pair of swinging pieces 22 and 23 is formed so that a distance between distal ends thereof can be increased and reduced.

A gripper 38 and a locking part 39 are provided on a circumference of the large-diameter portion 26*a*. The gripper 38 grips a winding start end 18*a* of a wire 18. The locking part 39 locks a winding finish end 18*b* of the wire 18. An operation button 38*a* (FIG. 4) for removing the gripped wire 18 from the gripper 38 is provided to the gripper 38 in a projecting manner. An operation mechanism (not shown) for operating the operation button 38*a* is provided to the mount 11.

The manufacturing apparatus 10 includes an operation piece 31. The operation piece 31 is inserted between the distal ends of the pair of swinging pieces 22 and 23 to increase the distance between the distal ends of the pair of swinging pieces 22 and 23, whereas the operation piece 31 is removed therefrom to reduce the distance. A third support wall 17 parallel to the first support wall 12 and the second support wall 13 is provided to stand vertically on the mount 11 at a predetermined distance from the first support wall 12 and the second support wall 13 in the Y-axis direction. A second rotary body 32 provided coaxially with the first rotary body 26 is provided on the third support wall 17 to extend in the Y-axis direction so as to be rotatable. The operation piece 31 is provided on an end surface of the second rotary body 32 opposed to the pair of swinging pieces 22 and 23 through an intermediation of a second guide member 37.

Figure 11:
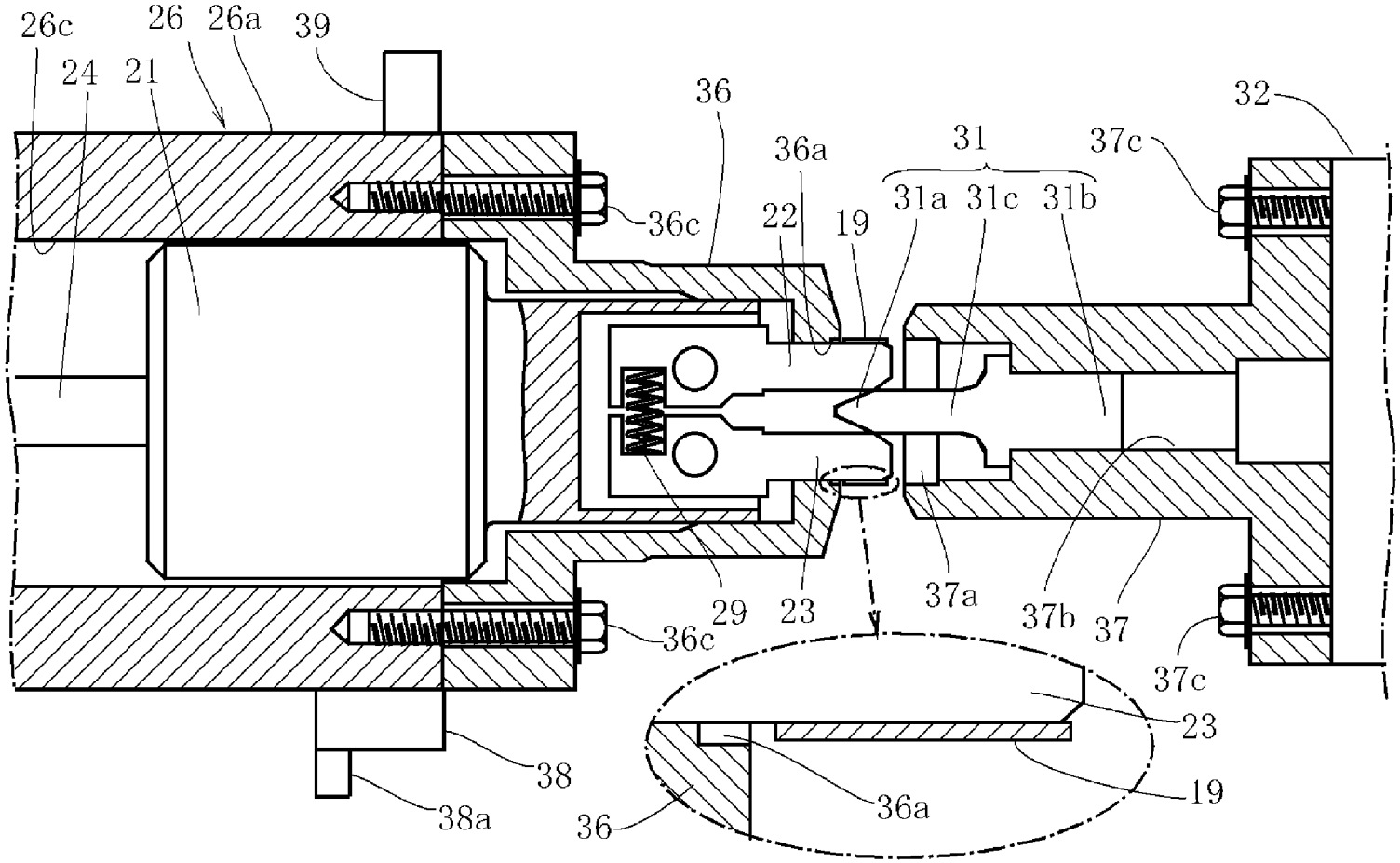
FIG. 11 is a sectional view illustrating a state in which the operation piece enters between the pair of swinging pieces to support the cylindrical bobbin.

As illustrated in FIGS. 1 to 4, a tapered portion 31*a* having a truncated conical shape having an outer diameter reducing toward the pair of swinging pieces 22 and 23 is formed at a distal end of the operation piece 31. A coil spring 29 (FIG. 4) is provided between the swinging pieces 22 and 23 as a biasing member for biasing the pair of swinging pieces 22 and 23 in a direction in which the distance between the distal ends of the swinging pieces 22 and 23 becomes smaller. As illustrated in FIG. 11, when the tapered portion 31*a* of the operation piece 31 is inserted between the distal ends of the swinging pieces 22 and 23 against the biasing force of the coil spring 29, the distance between the distal ends of the swinging pieces 22 and 23 is increased (FIG. 1B). Conversely, when the operation piece 31 is removed from between the distal ends of the swinging pieces 22 and 23 as illustrated in FIGS.

1A and 4, the distance between the distal ends of the swinging pieces 22 and 23 is reduced by the biasing force of the coil spring 29.

As illustrated in FIG. 5, the manufacturing apparatus 10 includes an insertion/removal mechanism 40. The insertion/removal mechanism 40 moves the pair of swinging pieces 22 and 23 together with the first rotary body 26 to insert the operation piece 31 and remove the operation piece 31 from between the distal ends of the pair of swinging pieces 22 and 23. The insertion/removal mechanism 40 includes a ball screw 42, a servomotor 43, and a movable base 44. The ball screw 42 is supported by the first support wall 12 and the second support wall 13 in parallel to the first rotary body 26. The servomotor 43 rotates the ball screw 42. The movable base 44 is threadably fitted over the ball screw 42 to move in the Y-axis direction. The first rotary body 26 is mounted so as to be immovable relative to the movable base 44 in the axis direction and rotatable relative thereto. As a result, when the servomotor 43 performs driving to rotate the ball screw 42 to move the movable base 44 in the Y-axis direction, the first rotary body 26 moves in the Y-axis direction together with the movable base 44.

When the first rotary body 26 moves in the axial direction (Y-axis direction), the second rotary body 32 does not move. Therefore, the pair of swinging pieces 22 and 23 provided to the first rotary body 26 moves closer to or away from the operation piece 31 provided to the second rotary body 32. When the insertion/removal mechanism 40 is driven to move the pair of swinging pieces 22 and 23 closer to the operation piece 31 as described above, the operation piece 31 can be inserted between the distal ends of the swinging pieces 22 and 23. On the other hand, when the insertion/removal mechanism 40 is driven to move the pair of swinging pieces 22 and 23 away from the operation piece 31, the operation piece 31 can be removed from between the distal ends of the swinging pieces 22 and 23.

The manufacturing apparatus 10 includes a winding mechanism. The winding mechanism rotates the pair of swinging pieces 22 and 23 having the distal ends, between which the operation piece 31 is inserted, together with the operation piece 31 to wind the wire 18 around an outer circumference of a distal end of the pair of swinging pieces 22 and 23 as a whole, which is enlarged by the insertion of the operation piece 31 between the distal ends of the swinging pieces 22 and 23 (hereinafter referred to simply as "enlarged outer circumference of the distal end of the pair of swinging pieces 22 and 23"). The winding mechanism includes a first servomotor 14 and a second servomotor 27. The first servomotor 14 rotates the first rotary body 26 together with the core 24. The second servomotor 27 rotates the second rotary body 32 together with the operation piece 31.

The first servomotor 14 is mounted to the second support wall 13. A pulley 16*b* is coupled to the first rotary body 26, whereas a pulley 16*a* is mounted to a rotary shaft 14*a* of the first servomotor 14. A belt 16*c* is looped around the pulleys 16*a* and 16*b*. The pulley 16*b* is provided to the second support wall 13 so as to be relatively movable in the longitudinal direction of the first rotary body 26. When the first servomotor 14 is driven to rotate the rotary shaft 14*a*, the rotation of the rotary shaft 14*a* is transmitted to the first rotary body 16 through the belt 16*c*. As a result, the first rotary body 26 rotates together with the core 24.

The second servomotor 27 is mounted to the third support wall 17. A pulley 28*b* is coupled to the second rotary body 32, whereas a pulley 28*a* is coupled to a rotary shaft 27*a* of the second servomotor 27. A belt 28*c* is looped around the pulleys 28*a* and 28*b*. When the second servomotor 27 is driven to rotate the rotary shaft 27*a*, the rotation of the rotary shaft 27*a* is transmitted to the second rotary shaft 32 through the belt 28*c*. As a result, the second rotary body 32 rotates together with the operation piece 31. The first servomotor 14 and the second servomotor 27 operate in synchronization with each other to rotate both the pair of swinging pieces 22 and 23 and the operation piece 31 in the same direction at the same rotation speed. In this manner, the wire 18 is wound around the enlarged outer circumference of the distal end of the pair of swinging pieces 22 and 23.

Figure 6:
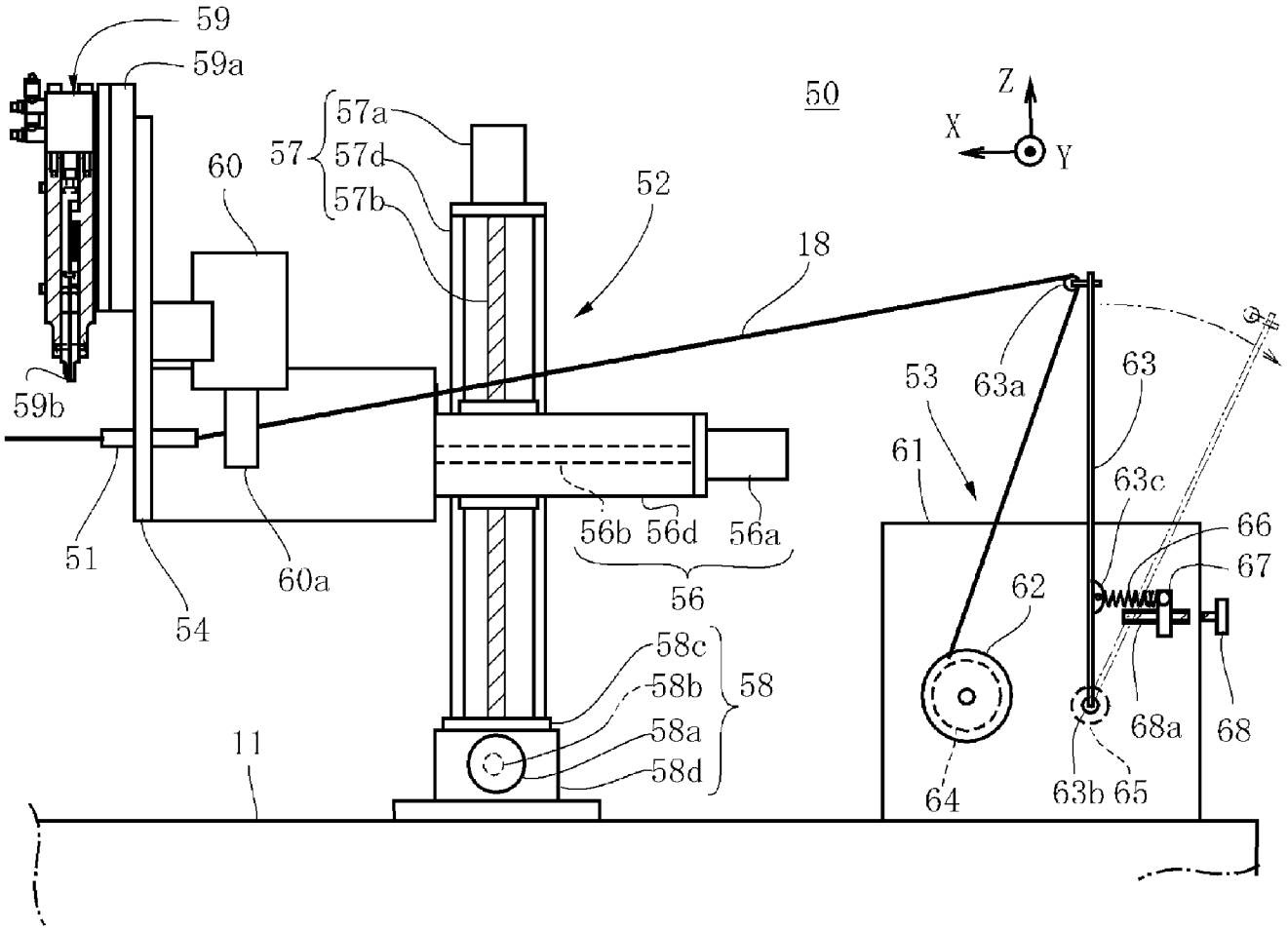
FIG. 6 is a diagram as viewed from a direction indicated by the arrow B in FIG. 5.

As illustrated in FIGS. 5 and 6, a wire feeding machine 50 is provided on the mount 11. The wire feeding machine 50 feeds the wire 18 to be wound around the enlarged outer circumference of the distal end of the pair of swinging pieces 22 and 23. The wire feeding machine 50 includes a nozzle 51, a nozzle moving mechanism 52, and a tension device 53. The wire 18 passes through the nozzle 51. The nozzle moving mechanism 52 moves the nozzle 51 in three axial directions. The tension device 53 applies a tension to the wire 18. The nozzle 51 is fixed to a support plate 54. The nozzle moving mechanism 52 moves the support plate 54 in the three axial directions with respect to the mount 11.

The nozzle moving mechanism 52 includes the combination of an X-axis direction expansion actuator 56, a Y-axis direction expansion actuator 58, and a Z-axis direction expansion actuator 57. The X-axis direction expansion actuator 56 includes a housing 56*d*, a ball screw 56*b*, and a follower 56*c*. The housing 56*d* has an elongated box-like shape. The ball screw 56*b* is provided inside the housing 56*d* so as to extend in the longitudinal direction, and is rotationally driven by the servomotor 56*a*. The follower 56*c* is threadably fitted over the ball screw 56*b* to move. Similarly to the X-axis direction expansion actuator 56, the Z-axis direction expansion actuator 57 includes a housing 57*d*, a ball screw 57*b*, and a follower 57*c*, whereas the Y-axis direction expansion actuator 58 includes a housing 58*d*, a ball screw 58*b*, and a follower 58*c*. When the servomotor 56*a* performs driving to rotate the ball screw 56*b*, the follower 56*c* threadably fitted over the ball screw 56*b* moves along the longitudinal direction of the housing 56*d*. The functions and the operations of the components of the Z-axis direction expansion actuator 57 and the Y-axis direction expansion actuator 58 are the same as those of the X-axis direction expansion actuator 56. Therefore, the detailed description thereof is herein omitted.

The support plate 54 through which the nozzle 51 is provided is mounted to the housing 56*d* of the X-axis direction expansion actuator 56. The follower 56*c* of the X-axis direction expansion actuator 56 is mounted to the follower 57*c* of the Z-axis direction expansion actuator 57. The housing 57*d* of the Z-axis direction expansion actuator 57 is mounted to the follower 58*c* of the Y-axis direction expansion actuator 58. The housing 58*d* of the Y-axis direction expansion actuator 58 extends in the Y-axis direction to be fixed to the mount 11. The servomotors 56*a* to 58*a* of the respective expansion actuators 56 to 58 are controlled by output signals output from a controller (not shown).

As illustrated in FIG. 6, besides the nozzle 51, a cutter device 59 (see Japanese Patent Application Laid-open No. 2011-217824) and a gripping device 60 are provided to the support plate 54. The cutter device 59 cuts the wire 18 passing through the nozzle 51 with an air pressure. The gripping device 60 grips the wire 18 with a gripping piece 60*a* to inhibit the movement of the wire 18 passing through the nozzle 51. The cutter device 59 is mounted to the support plate 54 through an intermediation of an air cylinder 59*a* which is driven by a command from the controller. The cutter device 59 is moved by the air cylinder 59*a* between a cutting position at which a cutter blade 59*b* cuts the wire 18 and a wait position at which the cutter blade 59*b* is separated away from the wire 18. The cutter device 59 and the gripping device 60 move together with the nozzle 51, and are controlled by output signals output from the controller.

The tension device 53 can apply a tension to the fed wire 18 and pull back the wire 18. The tension device 53 includes a casing 61, a drum 62, and a tension bar 63. The casing 61 is provided to the mount 11. The drum 62 and the tension bar 63 are provided on a side surface of the casing 61 in the Y-axis direction. The wire 18 is wound around the drum 62. Inside the casing 61, a feeding control motor 64 for rotating the drum 62 to feed the wire 18 is provided. The wire 18 fed from the drum 62 is guided by a wire guide 63*a* provided to a distal end of the tension bar 63. The wire 18 guided by the wire guide 63*a* passes from the wire guide 63*a* through the nozzle 51 to be wired.

The tension bar 63 is turnable in the X-axis direction about a turning shaft 63*b* at a base end as a fulcrum. An angle of turning of the turning shaft 63*b* is detected by a potentiometer 65. The potentiometer 65 is provided as turning angle detection means which is received within the casing 61, and is mounted to the rotary shaft 63*b*. A detection output of the potentiometer 65 is input to the controller. A control signal from the controller is output to the feeding control motor 64.

One end of a spring 66 is mounted at a predetermined position between the turning shaft 63*b* of the tension bar 63 and the wire guide 63*a* through an intermediation of a mounting bracket 63*c*. The spring 66 is an elastic member provided as biasing means for applying a biasing force in a direction of turning of the tension bar 63. An elastic force in accordance with the turning angle is applied to the tension bar 63 by the spring 66. Another end of the spring 66 is fixed to a moving member 67. The moving member 67 is threadably fitted over a male screw 68*a* of a tension adjusting screw 68. A position of the moving member 67 is adjusted in accordance with the rotation of the male screw 68*a*. In the above-mentioned manner, the fixed position of the another end of the spring 66 can be displaced. The tension on the wire 18, which is applied by the tension bar 63, is adjusted by the moving member 67.

The controller controls the feeding control motor 64 so that the turning angle detected by the potentiometer 65 becomes equal to a predetermined angle. The tension device 53 applies the tension to the wire 18 by the spring 66 through the tension bar 63 to rotate the drum 62 so that the turning angle of the tension bar 63 becomes a predetermined angle. In this manner, a predetermined amount of the wire 18 is fed. Thus, the tension of the wire 18 is maintained to a predetermined value.

As illustrated in FIGS. 1 to 5, the manufacturing apparatus 10 includes a first guide member 36 and the second guide member 37. Base ends of the swinging pieces 22 and 23 are inserted into the first guide member 36 so that the first guide member 36 restricts one side of a winding width of the wire 18 to be wound around a distal end side of the pair of swinging pieces 22 and 23. The distal end side of the pair of swinging pieces 22 and 23 is removably inserted into the second guide member 37 to restrict another side of the winding width of the wire 18 to be wound around the distal end side of the pair of swinging pieces 22 and 23. The first guide member 36 is fastened to an end of the first rotary body 26 by a bolt 36*c*, and is provided so as to surround the pair of swinging pieces 22 and 23. The second guide member 37 is fastened to an end of the second rotary body 32, which faces the pair of swinging pieces 22 and 23, by a bolt 37*c*.

In this embodiment, the manufacturing device 10 for winding the wire 18 around a cylindrical bobbin 19 mounted to the distal end of the pair of swinging pieces 22 and 23 is described. As the cylindrical bobbin 19, a paper bobbin made of a rolled sheet of paper, a resin bobbin made of a resin, and a bobbin made of a non-magnetic thin film are exemplified. As the resin bobbin, a bobbin made of a polyimide film (trade name: Kapton) is suitable, for example. The cylindrical bobbin 19 is supported by the distal end of the pair of swinging pieces 22 and 23 by inserting the operation piece 31 between the distal ends of the swinging pieces 22 and 23 to enlarge the distance between the distal ends of the swinging pieces 22 and 23, as illustrated in FIG. 11.

Figure 4:
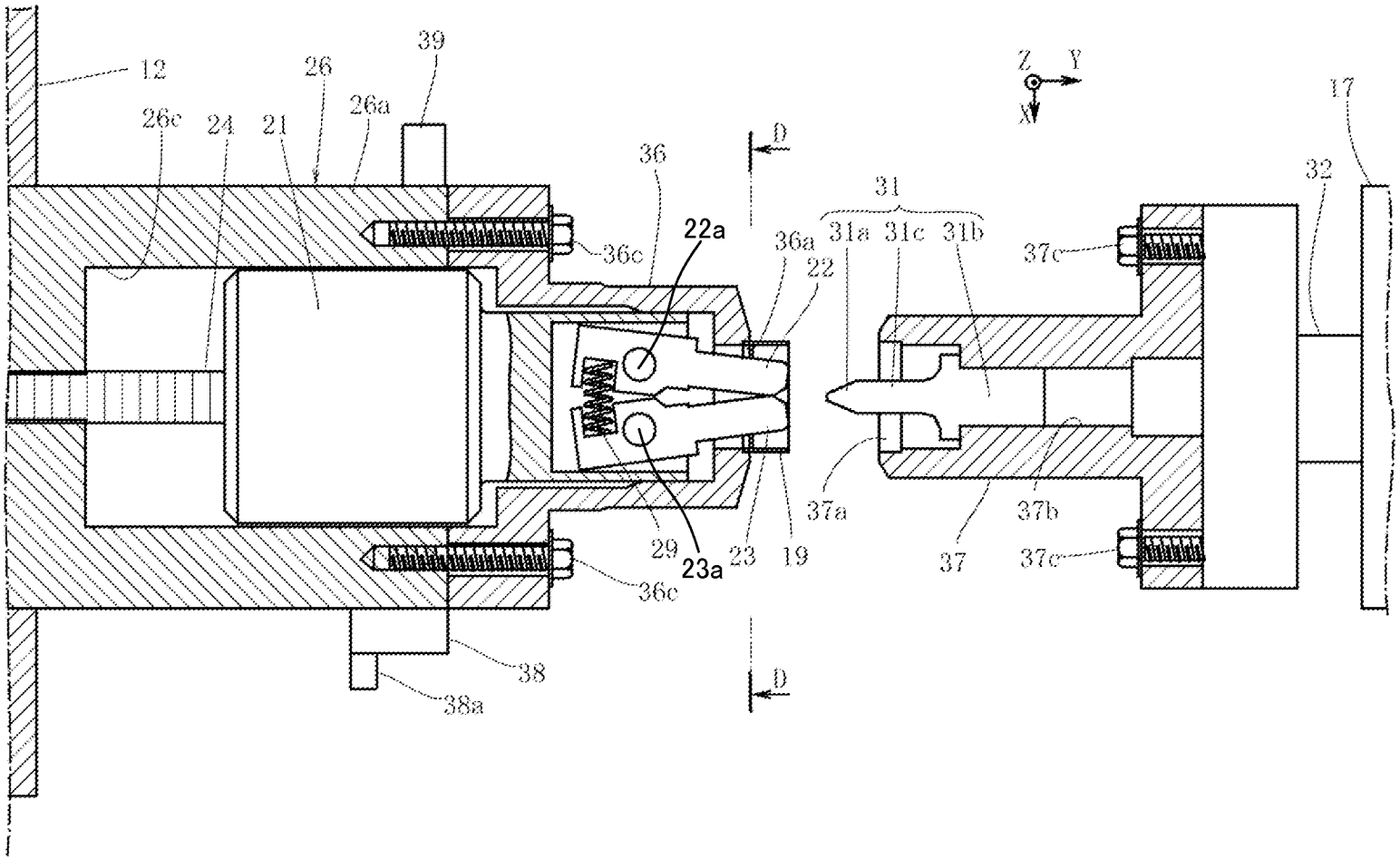
FIG. 4 is an enlarged sectional view of a portion A of FIG. 5.
Figure 12:
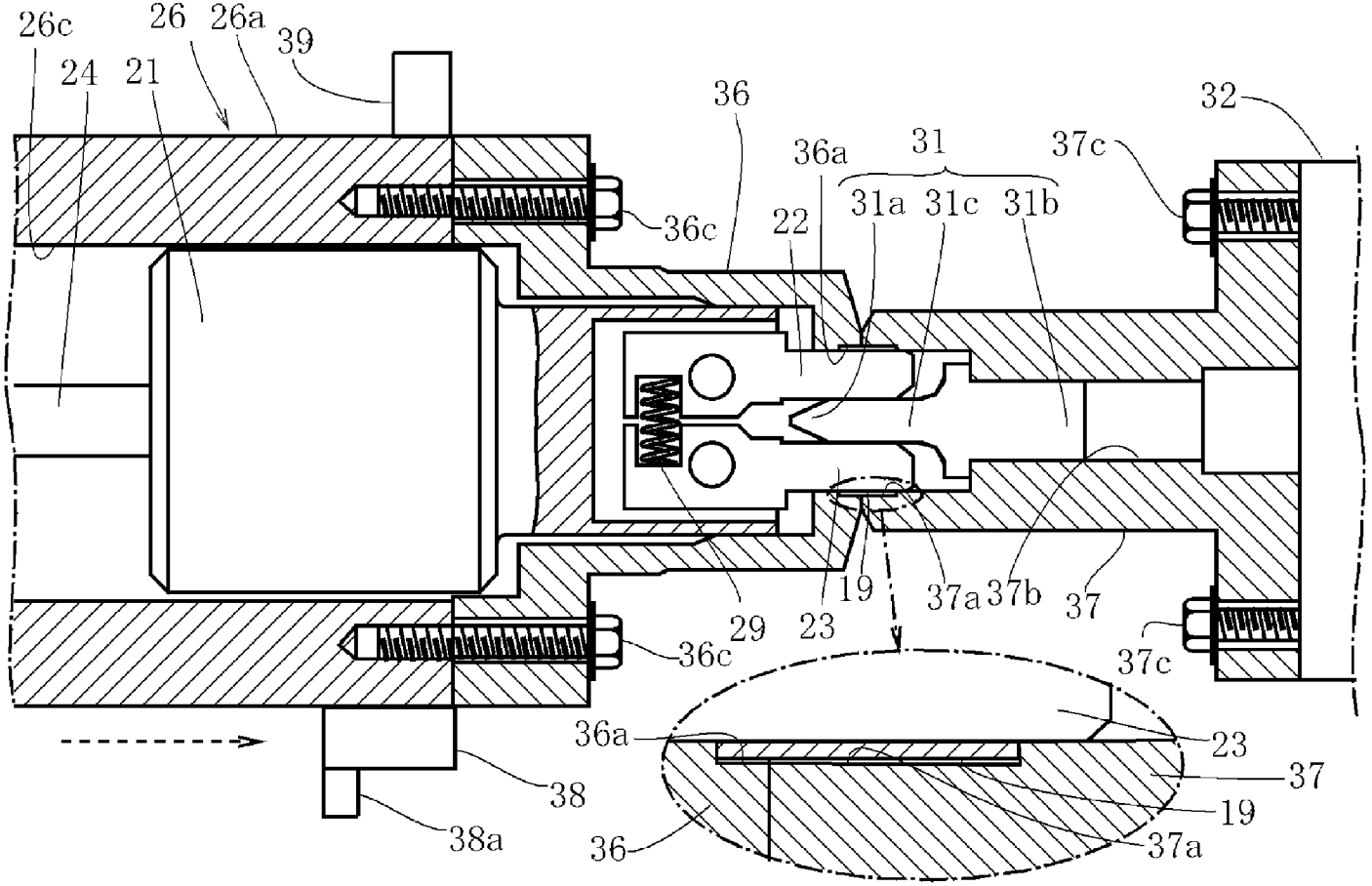
FIG. 12 is a sectional view illustrating a state in which the cylindrical bobbin is interposed between a first guide member and a second guide member.

As illustrated in FIG. 4, a first clearance 36*a* into which an outer circumferential edge of the cylindrical bobbin 19 on one side moves is formed between the first guide member 36 and the pair of swinging pieces 22 and 23. Moreover, as illustrated in FIG. 12, a second clearance 37*a* is formed between the second guide member 37 and the pair of swinging pieces 22 and 23. Into the second clearance 37*a*, the remaining portion of the outer circumferential edge of the cylindrical bobbin 19, which does not move into the first clearance 36*a*, moves in a state in which the second guide member 37 is held in abutment against the first guide member 36. Specifically, the outer circumferential edge of the cylindrical bobbin 19 on another side moves into the second clearance 37*a*.

Figure 13:
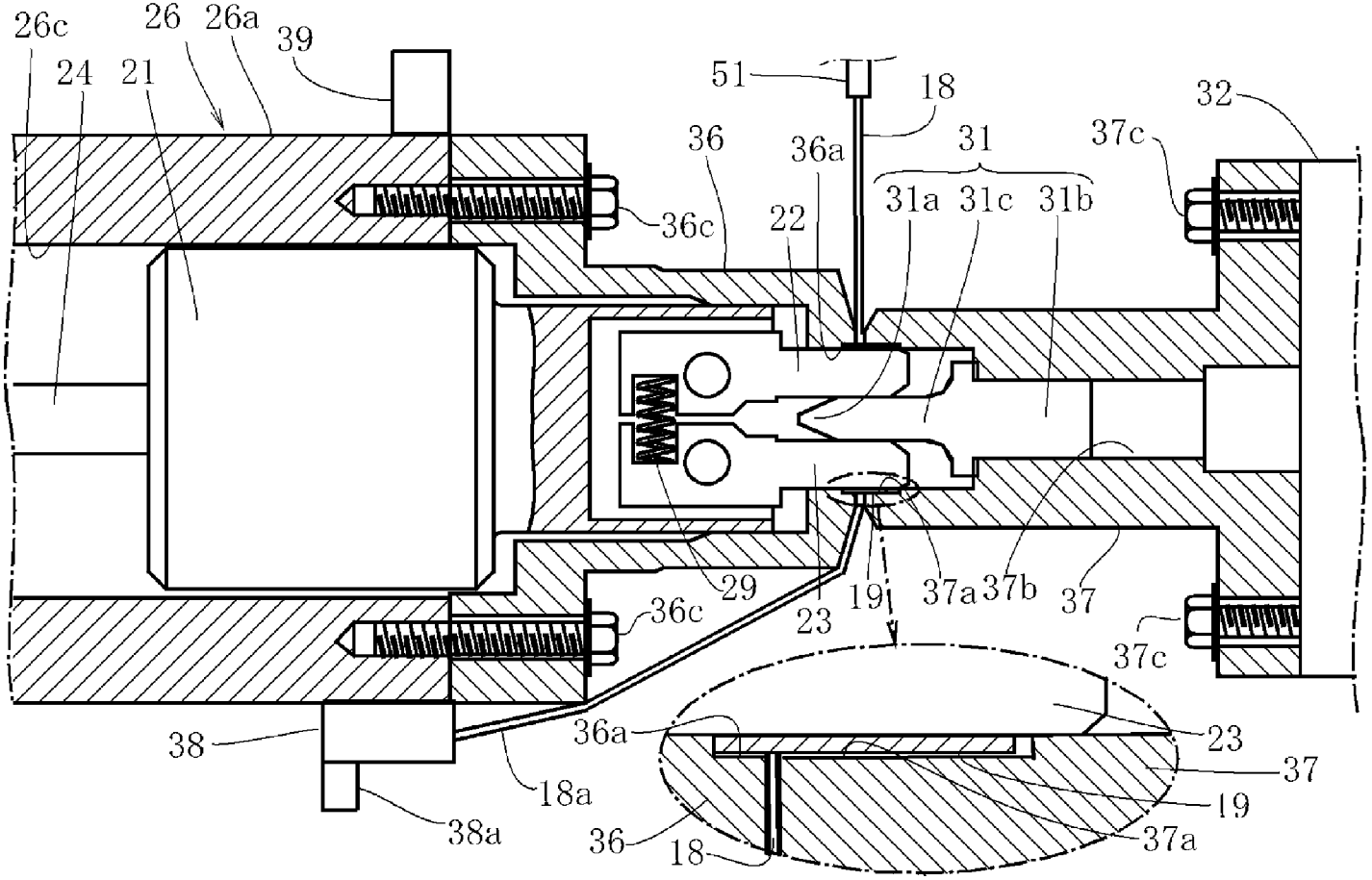
FIG. 13 is a sectional view illustrating a state in which a clearance is provided between the first guide member and the second guide member so that the wire passes therethrough.
Figure 14:
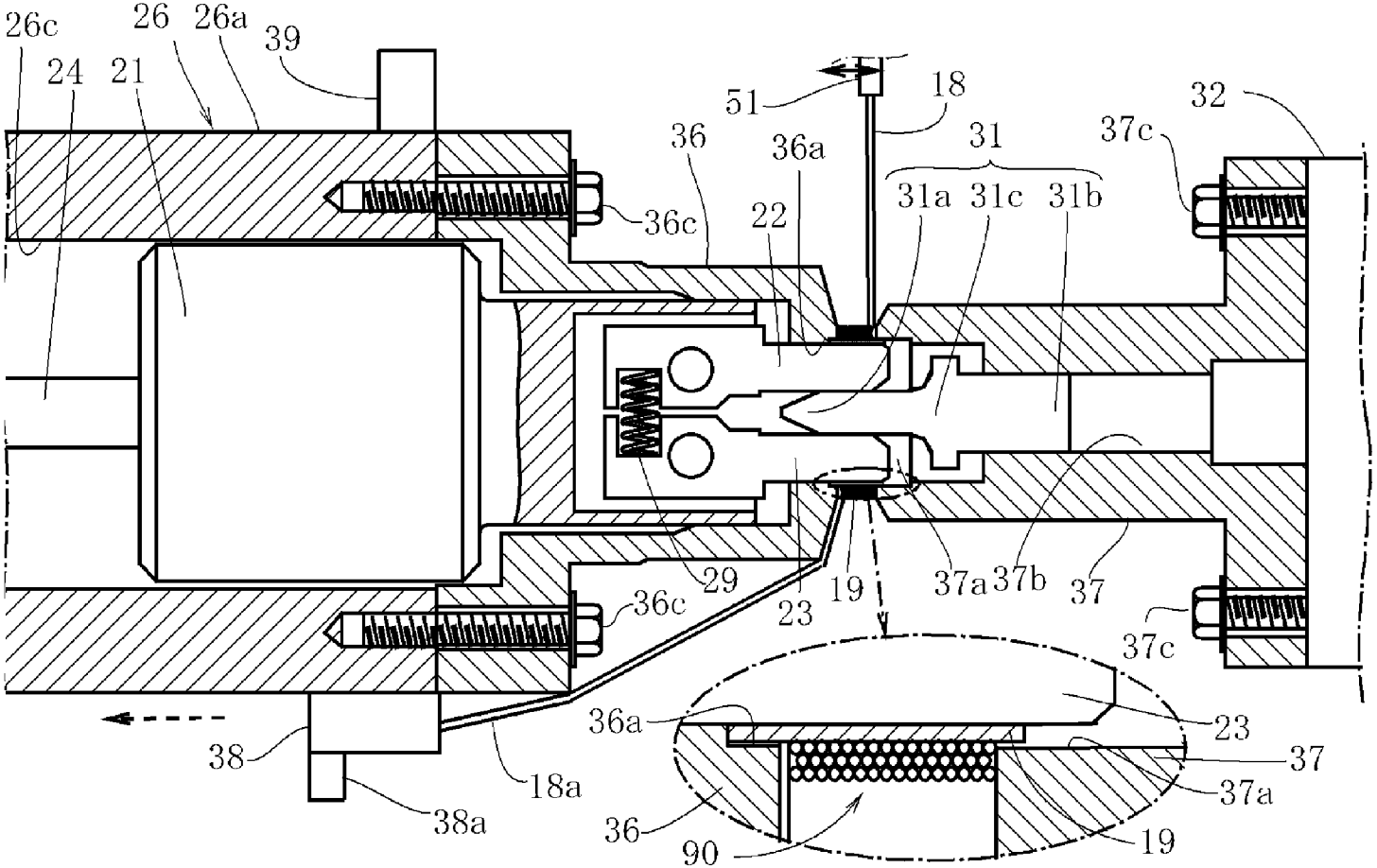
FIG. 14 is a sectional view illustrating a state in which the wire is wound around the cylindrical bobbin between the first guide member and the second guide member.

As illustrated in FIG. 4, the tapered portion 31*a* of the operation piece 31 is inserted between the distal ends of the swinging pieces 22 and 23 to push away the distal ends of the swinging pieces 22 and 23 to enlarge the distance between the distal ends thereof. The operation piece 31 is provided to the second rotary body 32 through an intermediation of the second guide member 37. A base end portion 31*b* of the operation piece 31 is mounted into a center hole 37*b* formed in a center axis of the second guide member 37 to fix the operation piece 31 to the second guide member 37. An intermediate portion 31*c* whose sectional shape in the axial direction remains unchanged is formed between the tapered portion 31*a* and the base end portion 31*b* of the operation piece 31. After the operation piece 31 enters between the distal ends of the swinging pieces 22 and 23 to enlarge the distance between the distal ends, the pair of swinging pieces 22 and 23 moves along the intermediate portion 31*c* of the operation piece 31 even when the pair of swinging pieces 22 and 23 and the operation piece 31 move relative to each other in the axial direction, as illustrated in FIGS. 12 to 14. Therefore, the distance between the distal ends of the swinging pieces 22 and 23 is neither increased nor reduced.

Figure 1A:
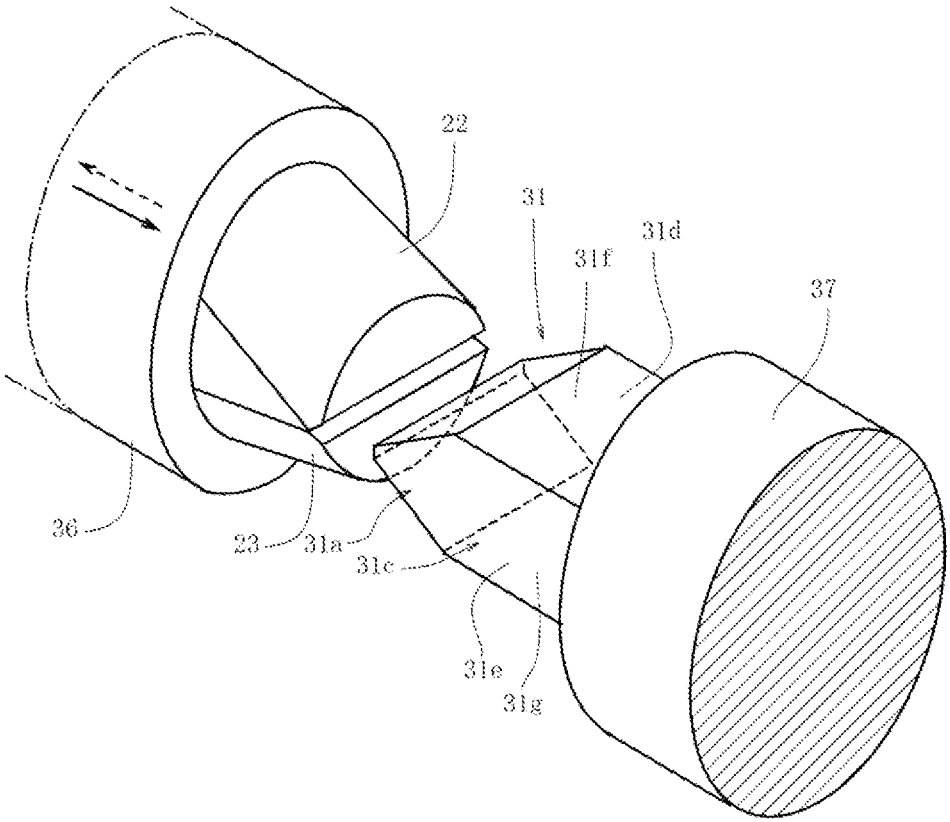
FIG. 1A is a perspective view illustrating a relationship between a pair of swinging pieces and an operation piece included in an apparatus for manufacturing a non-circular coil according to an embodiment of the present invention, in a state in which the operation piece is removed from between the pair of swinging pieces.
Figure 1B:
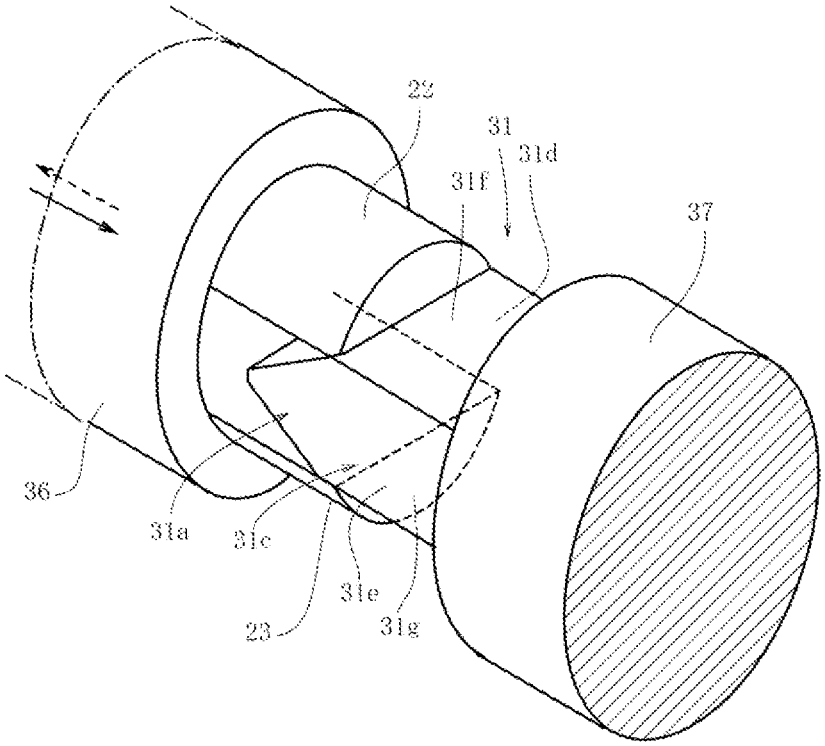
FIG. 1B is a perspective view illustrating the relationship between the pair of swinging pieces and the operation piece included in the apparatus for manufacturing a non-circular coil according to the embodiment of the present invention, in a state in which the operation piece is inserted between the pair of swinging pieces.
Figure 2:
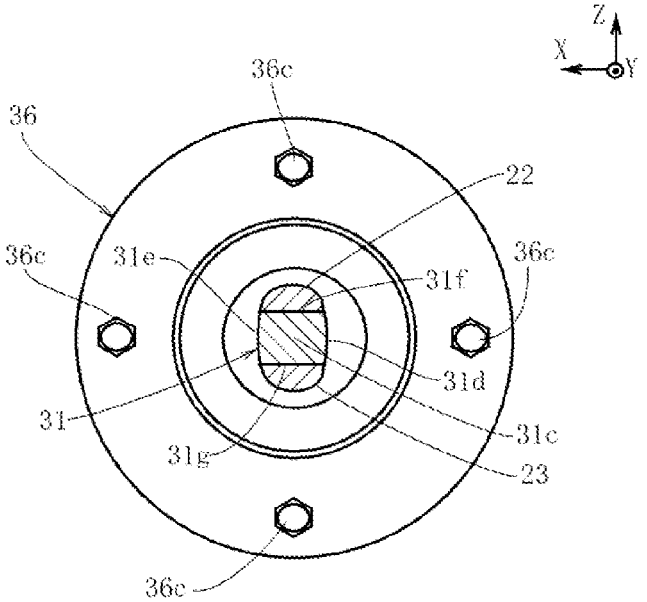
FIG. 2 is a sectional view taken along the line D-D in FIG. 4.
Figure 3:
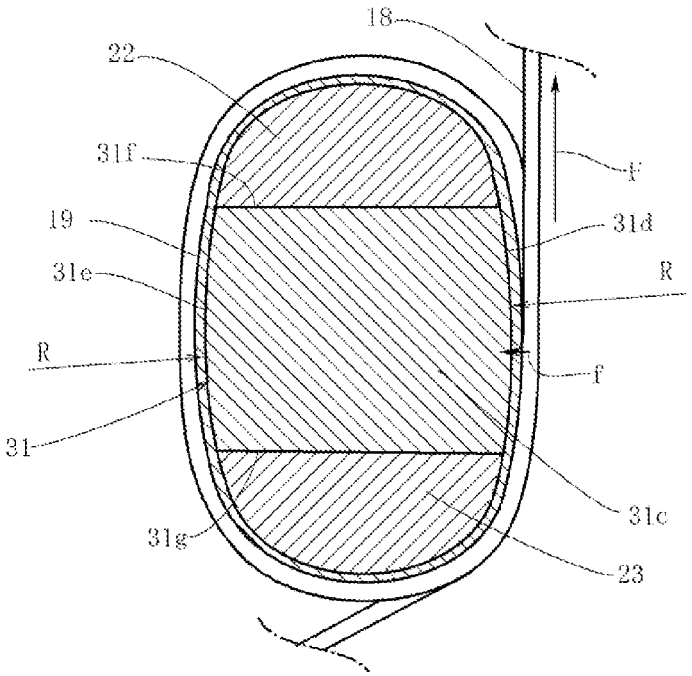
FIG. 3 is a sectional view illustrating a state in which a wire is wound around a cylindrical bobbin.

As illustrated in FIGS. 2 and 3, the intermediate portion 31*c* includes contact surfaces 31*f* and 31*g*. The contact surfaces 31*f* and 31*g* are held in contact with the swinging pieces 22 and 23 in a state in which the intermediate portion 31*c* is inserted between the distal ends of the swinging pieces 22 and 23. On the other hand, both side surfaces 31*d* and 31*e* of the intermediate portion 31*c*, which are not held in contact with the pair of swinging pieces 22 and 23, bulge outward to be curved. In addition, the side surfaces 31*d* and 31*e* are formed so as to be continuous with the outer circumferential surfaces of the swinging pieces 22 and 23 around which the wire 18 is wound. FIGS. 1 to 3 illustrate the case where a sectional shape of each of the swinging pieces 22 and 23 around which the wire 18 is wound is formed as an approximately semi-circular shape. Each of the side surfaces 31*d* and 31*e* of the intermediate portion 31*c* is formed as a curved surface which bulges outward so as to be continuous with the outer circumferential surfaces of the swinging pieces 22 and 23 having the semi-circular sectional shape.

Figure 8A:
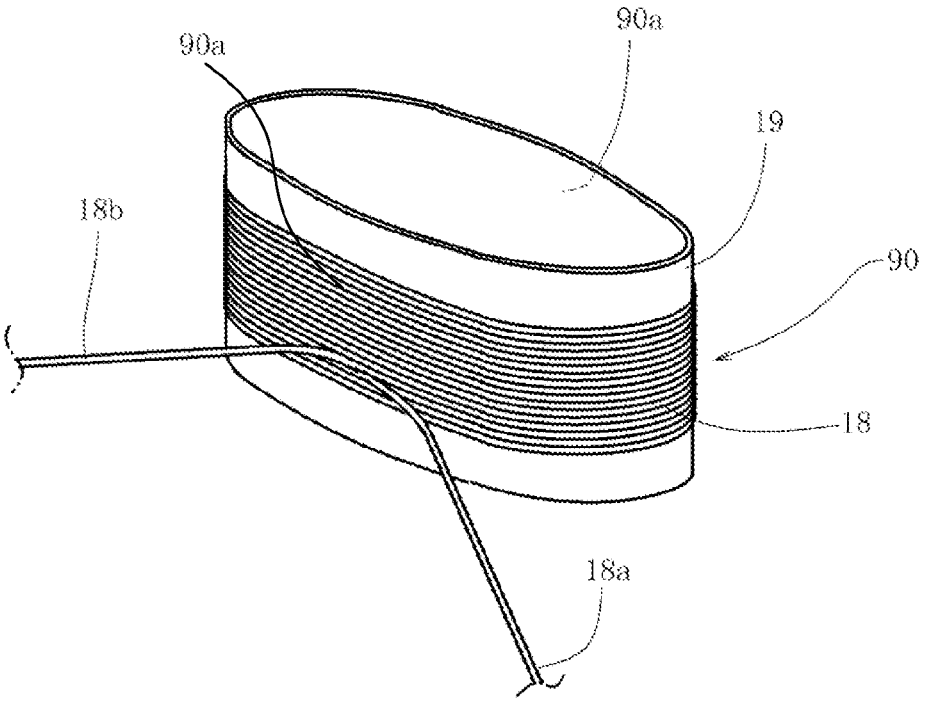
FIG. 8A is a perspective view of the non-circular coil obtained by winding the wire around the cylindrical bobbin in a case where the non-circular coil has an ellipsoidal sectional shape.

In this embodiment, the sectional shape of the pair of swinging pieces 22 and 23, which is enlarged by insertion of the operation piece 31, is a shape like an ellipsoid without a straight-line portion as a whole. Therefore, in this embodiment, the wire 18 is wound around the enlarged outer circumference of the distal end of the pair of swinging pieces 22 and 23, between which the operation piece 31 is inserted. As a result, a non-circular coil 90 having a shape like an ellipsoid is obtained, as illustrated in FIG. 8A.

Figure 7:
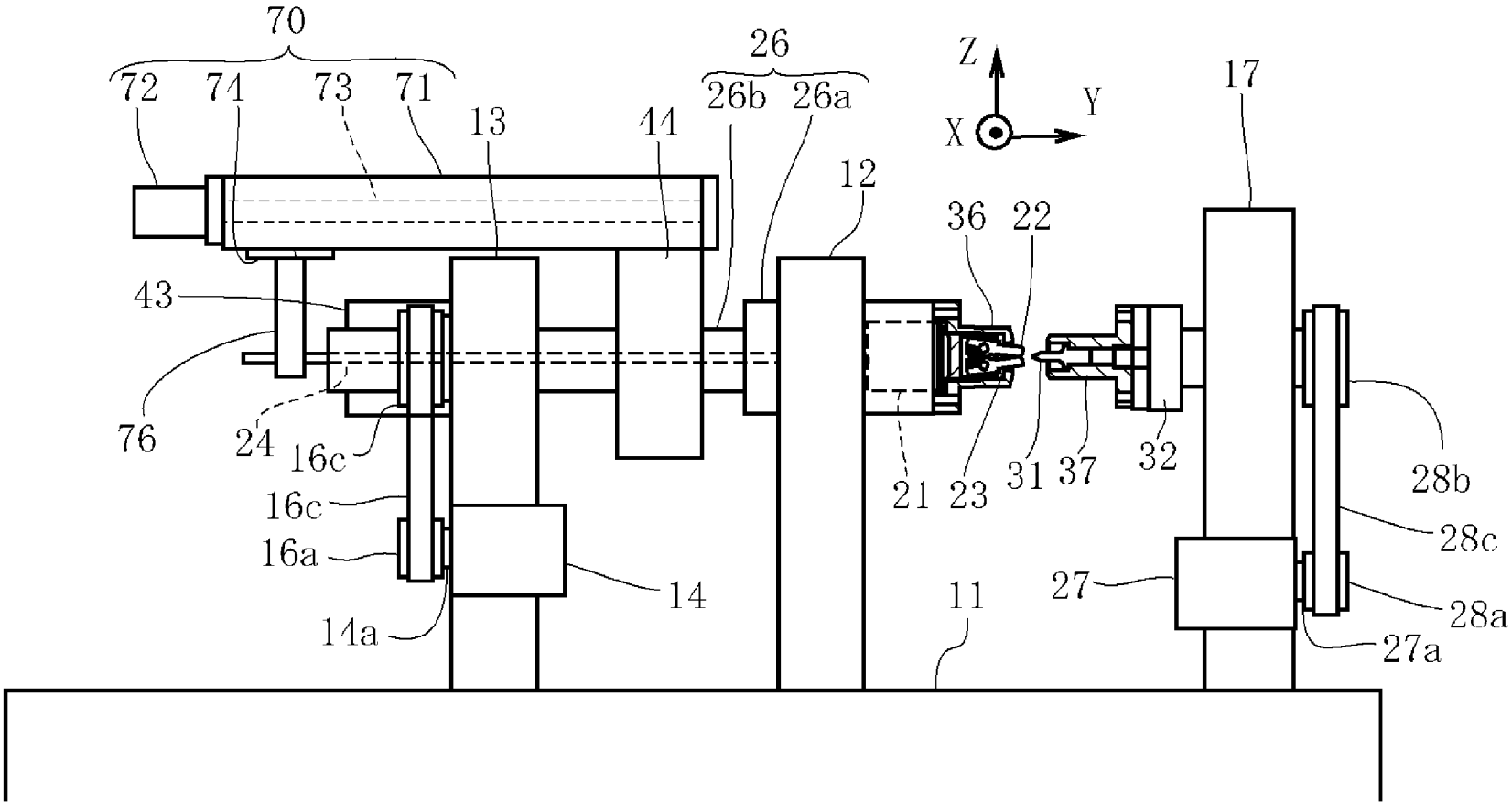
FIG. 7 is a sectional view taken along the line C-C in FIG. 5.
Figure 15:
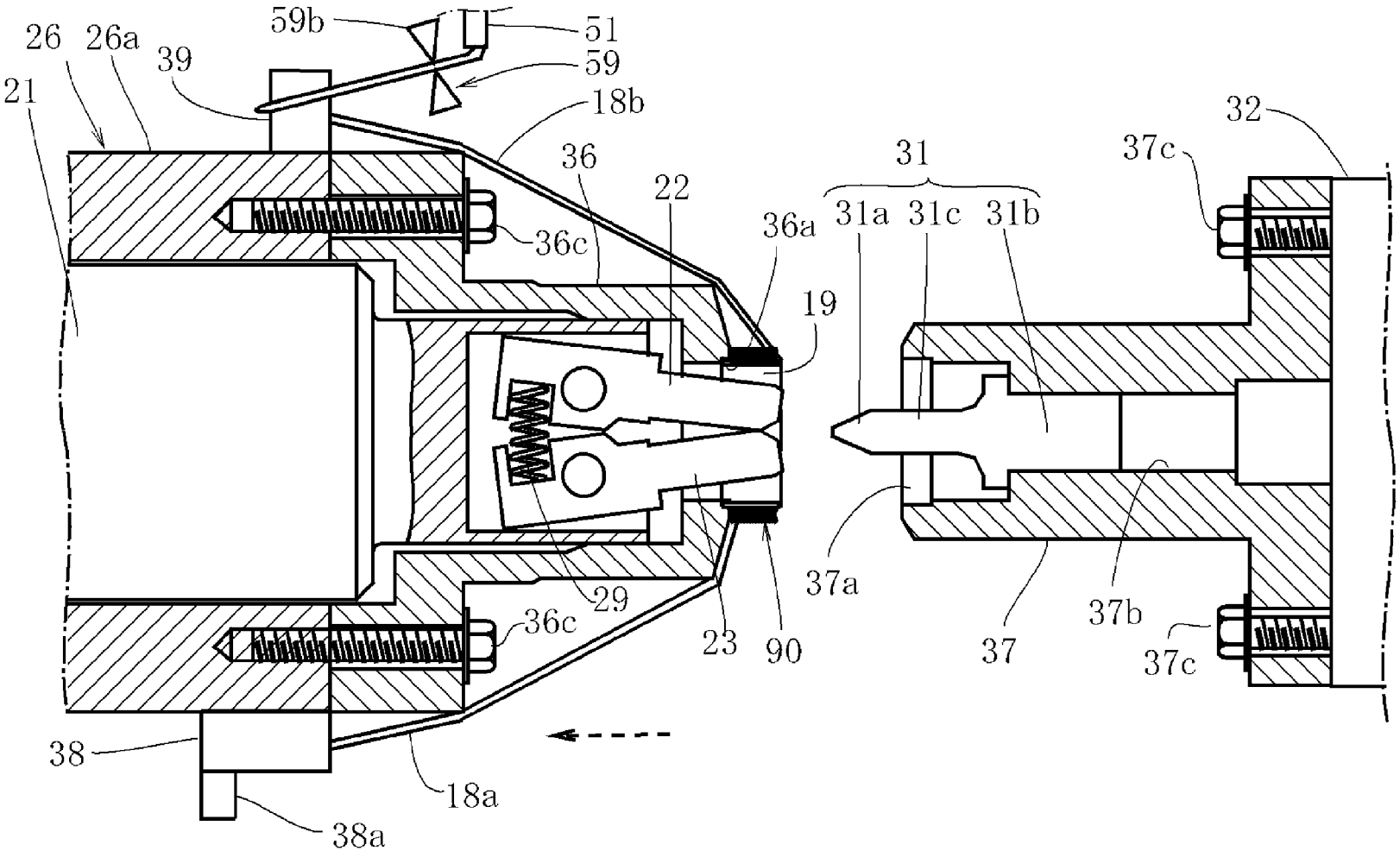
FIG. 15 is a sectional view illustrating a state in which the operation piece is removed from between the pair of swinging pieces.
Figure 16:
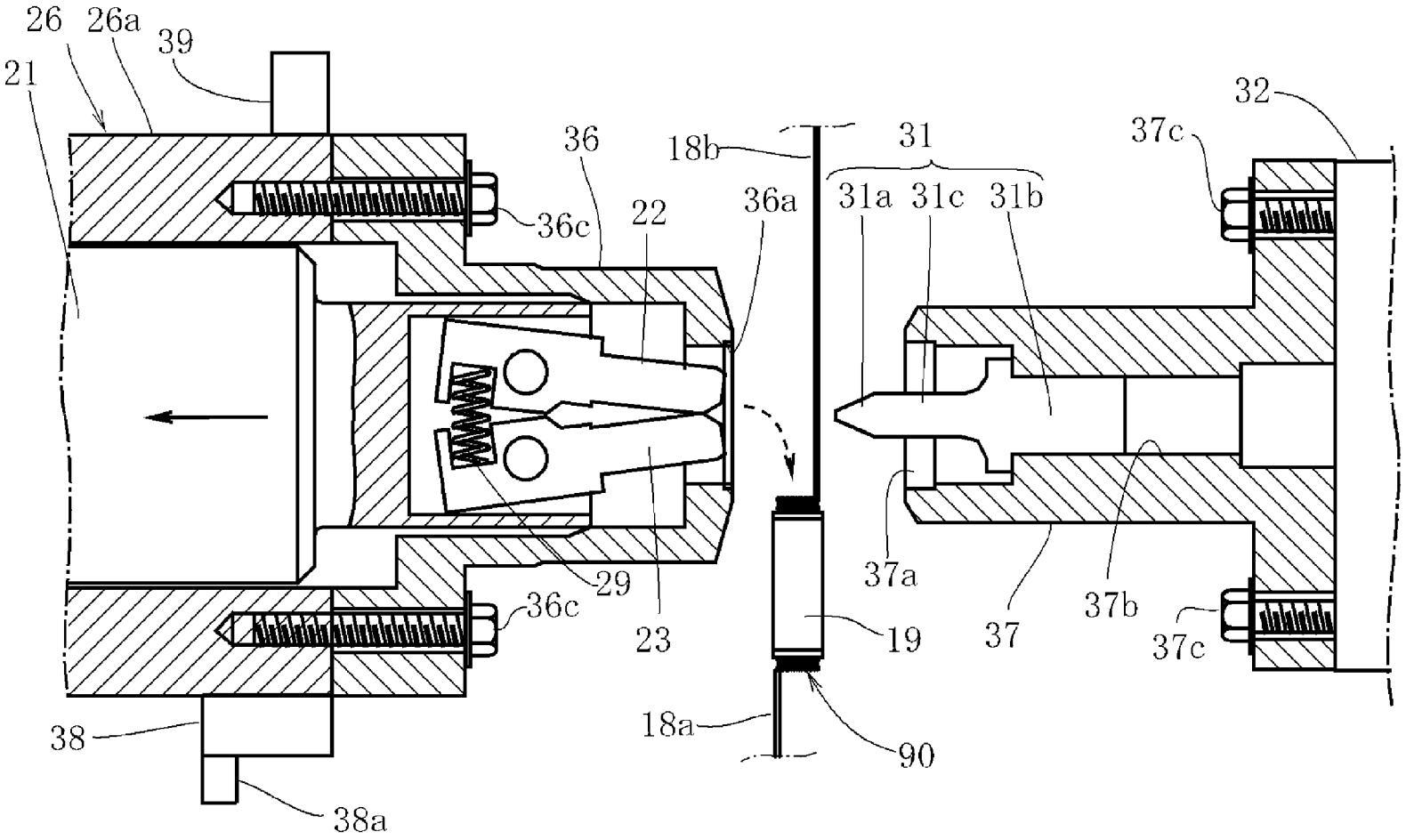
FIG. 16 is a sectional view illustrating a state in which the pair of swinging pieces is moved with respect to the first guide member to remove the non-circular coil together with the cylindrical bobbin.

As illustrated in FIG. 7, the manufacturing apparatus 10 includes a pull-out mechanism 70 for pulling out the pair of swinging pieces 22 and 23 from the first guide member 36. The pull-out mechanism 70 includes a housing 71, a ball screw 73, a follower 74, and a retaining member 76. The housing 71 is fixed to an upper portion of the movable base 44 so as to extend in the Y-axis direction. The ball screw 73 is rotationally driven by a servomotor 72. The follower 74 is threadably fitted over the ball screw 73 to be moved. The retaining member 76 is mounted to the follower 74. The pull-out mechanism 70 can move the core 24 in the Y-axis direction through an intermediation of the retaining member 76. Therefore, the pull-out mechanism 70 can move the core 24 toward the operation piece 31 to project the pair of swinging pieces 22 and 23 from the first guide member 36, as illustrated in FIG. 15. At the same time, the pull-out mechanism 70 can move the core 24 away from the operation piece 31 to pull out the pair of swinging pieces 22 and 23 from the first guide member 36, as illustrated in FIG. 16.

As illustrated in FIG. 5, a hot-air blower 81 is provided to the mount 11 through an intermediation of an air cylinder 82. An air nozzle 81*a* for blowing a hot air is provided to the hot-air blower 81. The hot-air blower 81 moves in a reciprocating manner between a first position (position indicated by an alternate long and short dash line in FIG. 5) and a second position (position indicated by a solid line in FIG. 5) by driving of the air cylinder 82. When the hot-air blower 81 is in the first position, an air outlet end of the air nozzle 81*a* faces a portion of the pair of swinging pieces 22 and 23, around which the wire 18 is wound. When the hot-air blower 81 is in the second position, the air outlet end of the air nozzle 81*a* is separated away from the pair of swinging pieces 22 and 23. The hot-air blower 81 is generally located in the second position. When an insulating coating of the wire 18 wound around the distal end of the pair of swinging pieces 22 and 23 is heated to be melted and is then cooled to be firmly fixed, the hot-air blower 81 is moved from the second position to the first position by the driving of the air cylinder 82 in response to a command from the controller. When being located in the first position, the hot-air blower 81 blows a hot air from the air nozzle 81*a* to melt the insulating coating of the wire 18 to be wound so that the insulating coating is firmly fixed.

Figure 9:
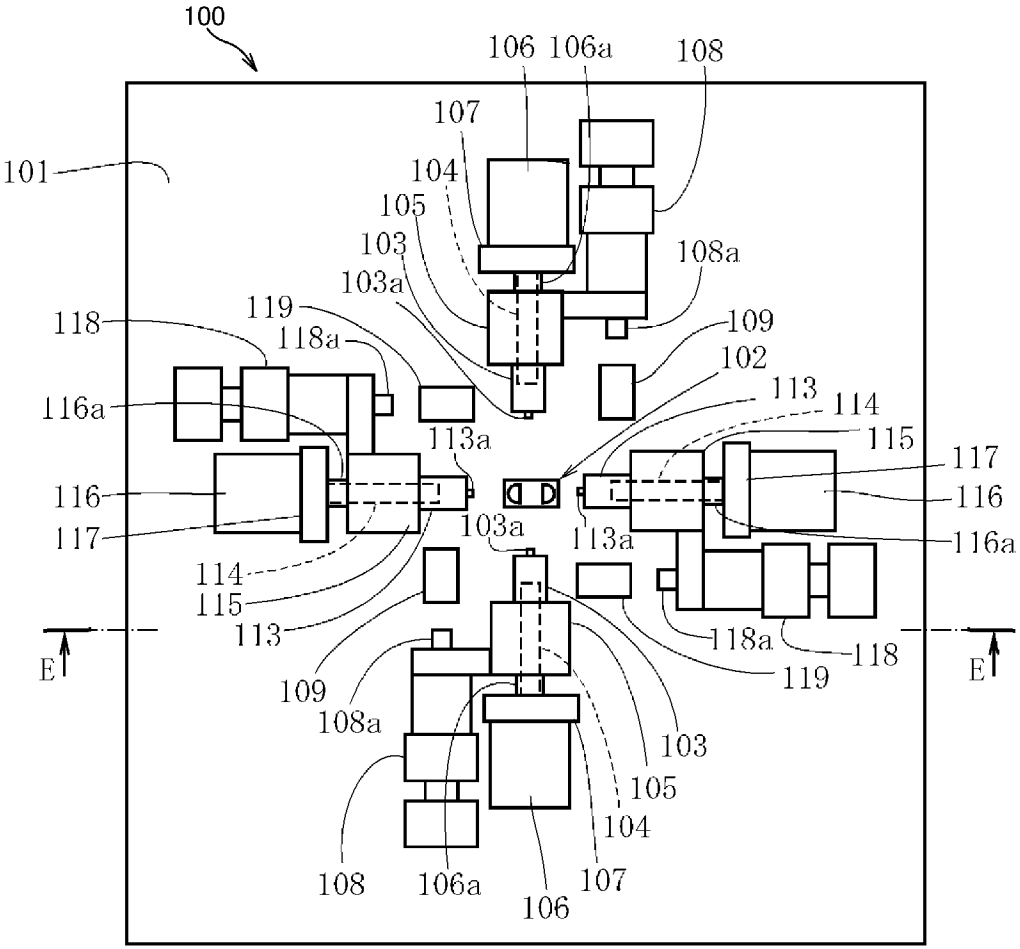
FIG. 9 is a plan view of a wire shaping device.
Figure 10:
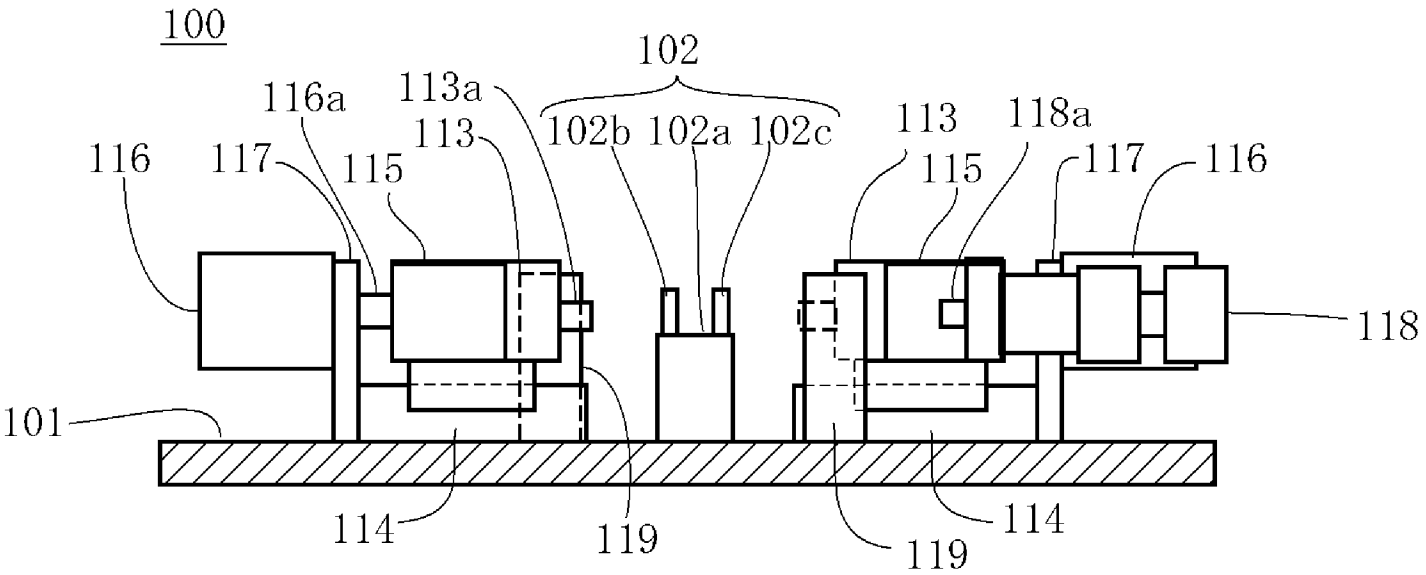
FIG. 10 is a sectional view taken along the line E-E in FIG. 9.
Figure 17:
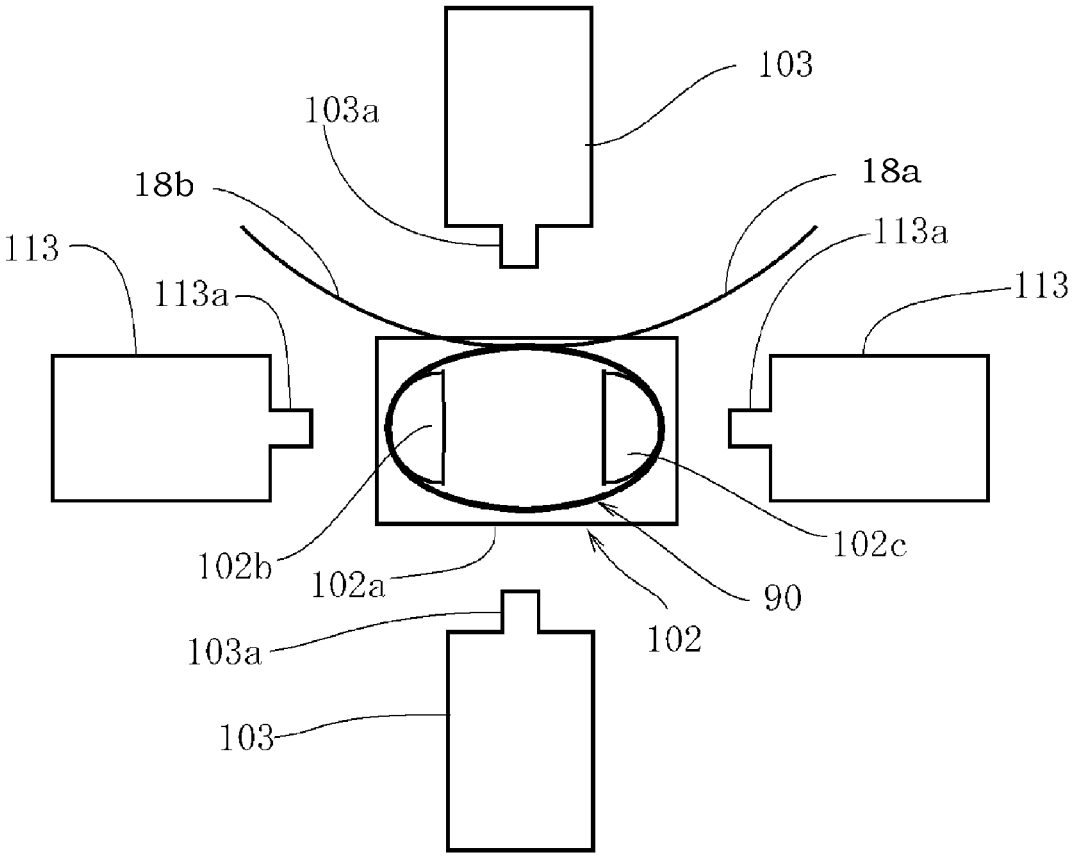
FIG. 17 is a plan view illustrating a state in which the non-circular coil is placed in the wire shaping device.

As illustrated in FIGS. 9 and 10, the manufacturing apparatus 10 includes a wire shaping device 100 for straightening the wire 18 which is curved to be wound in contact with the side surfaces 31*d* and 31*e* of the operation piece 31. The wire shaping device 100 includes a base 101. The base 101 is provided with a placement piece 102. On the placement piece 102, the non-circular coil 90 (FIG. 8A) obtained by winding the wire 18 around the enlarged outer circumference of the distal end of the pair of swinging pieces 22 and 23 is placed. In this embodiment, the non-circular coil 90 has an ellipsoidal shape. Therefore, the placement piece 102 includes a support base 102*a* and a pair of support pieces 102*b* and 102*c* (FIG. 17). The support base 102*a* supports a lower surface of the non-circular coil 90. The pair of support pieces 102*b* and 102*c* is provided so as to stand vertically on the support base 102*a*, and supports both end portions of the non-circular coil 90 in a long-diameter direction from the inner side. The pair of support pieces 102*b* and 102*c* is immovably fixed to the support base 102*a*.

The wire shaping device 100 includes a pair of pressing members 103 for sandwiching opposing curved portions 90*a* (FIG. 8A) formed in the non-circular coil 90 from both sides to press the curved portions 90*a* therebetween. On both sides of the placement piece 102 on the base 101, first rails 104 are linearly arranged so as to interpose the placement piece 102 therebetween. A first movable base 105 is provided to each of the first rails 104 so as to be movable in a reciprocating manner along the first rail 104. The pressing members 103 are respectively mounted to the first movable bases 105.

The wire shaping device 100 includes air cylinders 106 as pressing-member moving actuators for reducing a distance between the pressing members 103 so that the non-circular coil 90 is sandwiched between the pressing members 103. The air cylinder 106 is provided to a mounting base 107 which is provided to an end of each of the first rails 104 in the longitudinal direction to stand vertically on the base 101. A distal end of a rod 106*a* of the air cylinder 106 is mounted to the first movable base 105. A projecting piece 103*a* which projects toward the non-circular coil 90 is formed on each of the pressing members 103.

Figure 18:
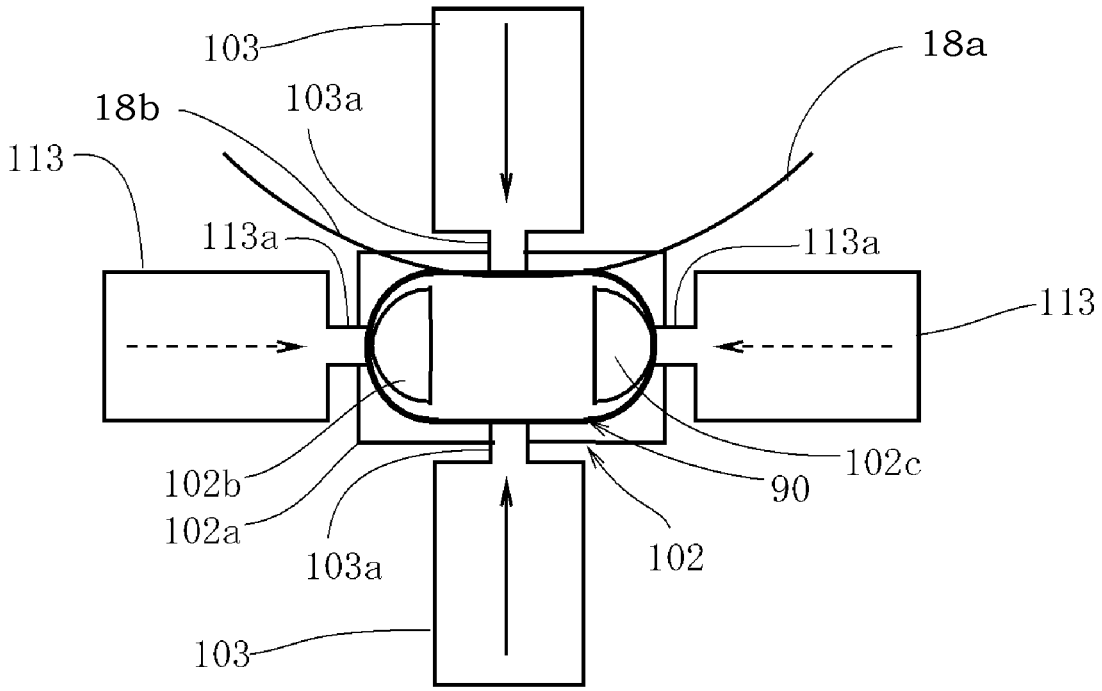
FIG. 18 is a plan view illustrating a state in which the non-circular coil having the ellipsoidal sectional shape is shaped into the oval sectional shape by using the wire shaping device.
Figure 19:
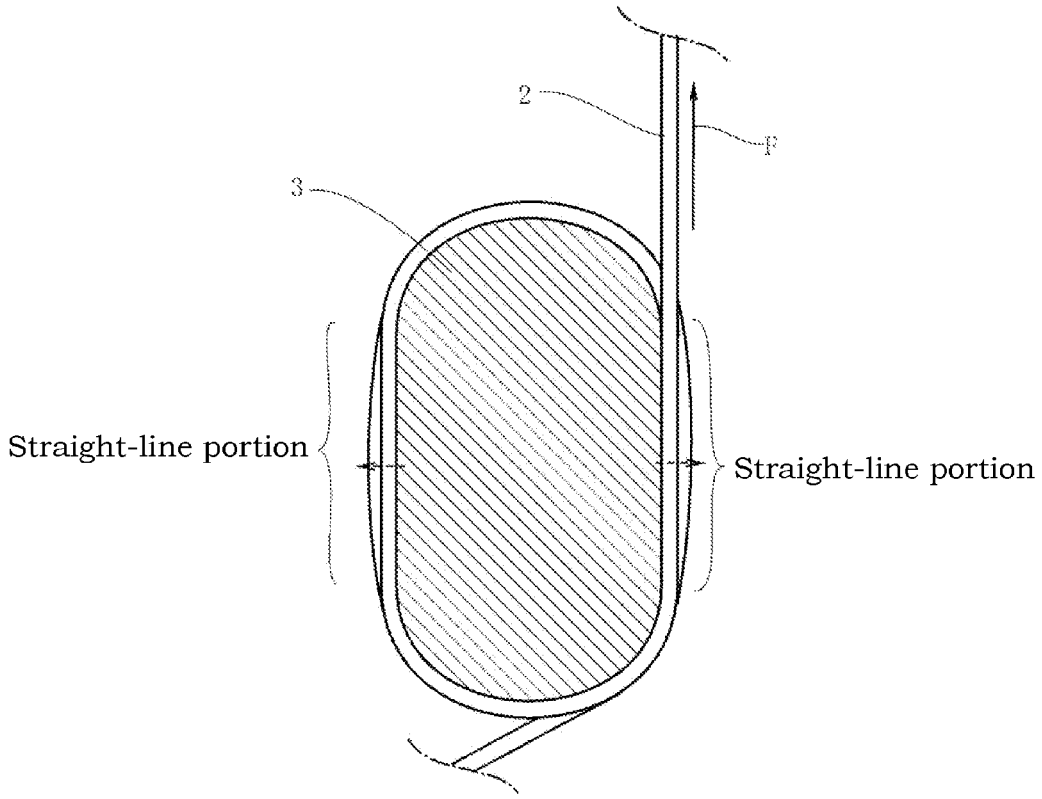
FIG. 19 is a sectional view illustrating a state in which a wire is wound around a core having an oval cross section by a conventional method.

When a compressed air is fed to the air cylinder 106, the rod 106*a* projects to move the pressing member 103 forward together with the first movable base 105. As a result, the pressing members 103 sandwich the curved portions 90*a* (FIG. 8A) on both sides of the non-circular coil 90 placed on the placement piece 102. As a result, the projecting pieces 103*a* of the pressing members 103 come into contact with the curved portions 90*a* to correct the curved portions 90*a* into a linear shape (FIG. 18). On the other hand, when the compressed air is exhausted from the air cylinder 106, the rod 106*a* is pulled to move the pressing members 103 backward together with the first movable base 105. As a result, the pressing members 103 move away from the placement piece 102. Thus, the removal of the non-circular coil 90 from the placement piece 102 and the placement of the non-circular coil 90 on the placement piece 102 can be performed (FIG. 17).

On the first movable base 105, micrometers 108 are mounted so as to be shifted from the pressing members 103. The micrometers 108 are provided in parallel to the first rails 104, respectively. Abutment members 109 are provided on the base 101. Distal ends of rotary shafts 108*a* of the micrometers 108 respectively come into abutment against the abutment members 109. By rotating the rotary shafts 108*a* of the micrometers 108 so that the rotary shafts 108*a* are projected and retracted, distances of movement of the pressing members 103 can be accurately adjusted. By the projection of the rods 106*a* of the air cylinders 106, the pressing members 103 come into contact with the non-circular coil 90 (FIG. 18). The amount of contact is adjusted by the micrometers 108.

The wire shaping device 100 includes a pair of support members 113 for sandwiching and holding the non-circular coil 90 in a direction perpendicular to the direction in which the pressing members 103 sandwich the non-circular coil 90 therebetween. Second rails 114, which are arranged linearly so as to interpose the placement piece 102 therebetween, are provided on the base 101 so as to perpendicularly cross the first rails 104. A second movable base 115 is provided to each of the second rails 114 so as to be movable in a reciprocating manner along the second rail 114. The support members 113 are mounted to the second movable bases 115, respectively.

The wire shaping device 100 includes air cylinders 116. The air cylinders 116 are provided as support-member moving actuators for reducing a distance between the support members 113 so that the pair of support members 113 restricts the extension of the non-circular coil 90 in the direction perpendicular to the direction in which the pressing members 103 sandwich the non-circular coil 90 therebetween, which is caused when the non-circular coil 90 is sandwiched between the pressing members 103. The air cylinder 116 is provided to a mounting base 117 which is provided to an end of each of the second rails 114 in the longitudinal direction to stand vertically on the base 101. A distal end of a rod 116*a* of the air cylinder 116 is mounted to the second movable base 115. A projecting piece 113*a* which projects toward the non-circular coil 90 is formed on each of the support members 113.

When a compressed air is fed to the air cylinder 116, the rod 116*a* projects to move the support member 113 forward together with the second movable base 115. As a result, the projecting pieces 113*a* of the pair of support members 113 come into contact with the non-circular coil 90 to restrict the extension of the non-circular coil 90 in the direction perpendicular to the direction in which the pressing members 103 sandwich the non-circular coil 90 therebetween (FIG. 18). On the other hand, when the compressed air is exhausted from the air cylinder 116, the rod 116*a* is pulled to move the support members 113 backward together with the second movable base 115. As a result, the support members 113 move away from the placement piece 102. Thus, the removal of the non-circular coil 90 from the placement piece 102 and the placement of the non-circular coil 90 on the placement piece 102 can be performed (FIG. 17).

On the second movable base 115, micrometers 118 are mounted so as to be shifted from the support members 113. The micrometers 118 are provided in parallel to the second rails 114, respectively. Abutment members 119 are provided on the base 101. Distal ends of rotary shafts 118*a* of the micrometers 118 respectively come into abutment against the abutment members 119. By rotating the rotary shafts 118*a* of the micrometers 118 so that the rotary shafts 118*a* are projected and retracted, distances of movement of the support members 113 can be accurately adjusted. By the projection of the rods 116*a* of the air cylinders 116, the support members 113 come into contact with the non-circular coil 90 to restrict the extension of the non-circular coil 90 (FIG. 18). The amounts of movement of the support members 113 to restrict the extension are adjusted by the micrometers 118, respectively.

In this embodiment, the non-circular coil 90 obtained by winding the wire 18 around the enlarged outer circumference of the distal end of the pair of swinging pieces 22 and 23 has an ellipsoidal shape. Therefore, the placement piece 102 is provided so that the pair of pressing members 103 is located in a short-diameter direction of the non-circular coil 90 and the pair of support members 113 is located in the long-diameter direction.

In the following, a method of manufacturing a non-circular coil according to this embodiment is described. Specifically, the method of manufacturing a non-circular coil by using the manufacturing device 10 is described below.

The method of manufacturing a non-circular coil includes an enlarging step, a winding step, a reducing step, and a coil-removing step. In the enlarging step, the operation piece 31 is inserted between the distal ends of the swinging pieces 22 and 23 whose base ends are swingably supported and distal ends are configured to enlarge and reduce the distance therebetween so that the distance between the distal ends of the swinging pieces 22 and 23 is enlarged. In the winding step, the operation piece 31 and the pair of swinging pieces 22 and 23 are rotated so as to wind the wire 18 around the enlarged outer circumference of the distal end of the pair of swinging pieces 22 and 23 by the insertion of the operation piece 31 to form the non-circular coil 90. In the reducing step, the operation piece 31 is removed from between the swinging pieces 22 and 23 to reduce the distance between the distal ends of the swinging pieces 22 and 23 around which the non-circular coil 90 is formed. In the coil-removing step, the non-circular coil 90 is removed from the reduced outer circumference of the distal end of the pair of swinging pieces 22 and 23.

The non-circular coil 90 may be formed around the cylindrical bobbin 19. In this case, a bobbin-mounting step of mounting the cylindrical bobbin 19 to the distal end of the pair of swinging pieces 22 and 23 having the reduced distance between the distal ends is performed prior to the enlarging step of enlarging the distance between the distal ends of the swinging pieces 22 and 23. In the winding step, the wire 18 is wound around the outer circumference of the cylindrical bobbin 19. In the coil-removing step, the non-circular coil 90 is removed together with the cylindrical bobbin 19. In this embodiment, the case where the non-circular coil 90 having an ellipsoidal shape is formed around the cylindrical bobbin 19 is described. In the following, the steps are respectively described.

(Bobbin-Mounting Step)

In the bobbin-mounting step, the cylindrical bobbin 19 is mounted to the distal end of the pair of swinging pieces 22 and 23 having the reduced distance between the distal ends. First, by driving the servomotor 72 of the pull-out mechanism 70 illustrated in FIG. 7, the core 24 is moved toward the operation piece 31 through an intermediation of the retaining member 76 to project the pair of swinging pieces 22 and 23 from the first guide member 36. Next, by driving the servomotor 43 of the insertion/removal mechanism 40 illustrated in FIG. 5, the pair of swinging pieces 22 and 23 is moved away from the operation piece 31 to remove the operation piece 31 from between the distal ends of the swinging pieces 22 and 23. As a result, the distance between the distal ends of the swinging pieces 22 and 23 is reduced by the biasing force of the coil spring 29. Next, as illustrated in FIG. 4, the cylindrical bobbin 19 is mounted to the distal end of the pair of swinging pieces 22 and 23 having the reduced distance between the distal ends.

(Enlarging Step)

In the enlarging step, the distance between the distal ends of the swinging pieces 22 and 23 is enlarged. The cylindrical bobbin 19 is held on the enlarged outer circumference of the distal end of the pair of swinging pieces 22 and 23. By rotating the servomotor 43 of the insertion/removal mechanism 40 in the direction opposite to that in the bobbin-mounting step, the pair of swinging pieces 22 and 23 is moved closer to the operation piece 31 to insert the operation piece 31 between the distal ends of the swinging pieces 22 and 23. As a result, the operation piece 31 is inserted between the distal ends of the swinging pieces 22 and 23 to enlarge the distance between the distal ends of the swinging pieces 22 and 23 as illustrated in FIG. 11. The cylindrical bobbin 19 is held on the enlarged outer circumference of the distal end of the pair of swinging pieces 22 and 23.

When the operation piece 31 is inserted between the distal ends of the swinging pieces 22 and 23, the distal end side of the pair of swinging pieces 22 and 23 is inserted into the second guide member 37 which is provided so as to surround the operation piece 31. Further, when the operation piece 31 is inserted between the distal ends of the swinging pieces 22 and 23, the outer circumferential edge of the cylindrical bobbin 19 on the operation piece 31 side moves into the second clearance 37*a* formed in the second guide member 37. Still further, when the operation piece 31 is inserted between the distal ends of the swinging pieces 22 and 23, the end surface of the first guide member 36 provided around the pair of swinging pieces 22 and 23 and the end surface of the second guide member 37 come into abutment against each other, as illustrated in FIG. 12. At the same time, the outer circumferential edge of the cylindrical bobbin 19 on the side of the pair of swinging pieces 22 and 23 moves into the first clearance 36*a* formed in the first guide member 36. Specifically, in a state in which the first guide member 36 and the second guide member 37 abut against each other, the second clearance 37*a*, into which the remaining portion of the outer circumferential edge of the cylindrical bobbin 19 which does not move into the first clearance 36*a* moves, is formed between the second guide member 37 and the pair of swinging pieces 22 and 23.

As described above, in the enlarging step, the outer circumferential edge of the cylindrical bobbin 19 on the one side moves into the first clearance 36*a* between the first guide member 36 and the pair of swinging pieces 22 and 23, while the outer circumferential edge of the cylindrical bobbin 19 on the another side moves into the second clearance 37*a* between the second guide member 37 and the pair of swinging pieces 22 and 23. As a result, the axial position of the cylindrical bobbin 19 is determined with respect to the pair of swinging pieces 22 and 23.

(Winding Step)

In the winding step, the wire 18 is wound around the enlarged outer circumference of the distal end of the pair of swinging pieces 22 and 23 to form the non-circular coil 90 (FIG. 8A) at the distal end of the pair of swinging pieces 22 and 23. In this embodiment, the wire 18 is wound around the outer circumference of the cylindrical bobbin 19 between the first guide member 36 and the second guide member 37. Specifically, as illustrated in FIG. 13, the end portion of the wire 18 fed to pass through the nozzle 51 is gripped as the winding start end 18*a* by the gripper 38. The end portion of the wire 18 is gripped by the gripper 38 in the following manner. The operation button 38*a* is operated by the operation mechanism (not shown) to open the gripper 38. After the wire 18 fed to pass through the nozzle 51 is inserted through the opened gripper 38, the operation button 38*a* of the gripper 38 is operated again. As a result, the wire 18 fed to pass through the nozzle 51 is gripped by the gripper 38.

Next, by driving the servomotor 43 of the insertion/removal mechanism 40 illustrated in FIG. 5, the pair of swinging pieces 22 and 23 is moved together with the first guide member 36 away from the operation piece 31. As a result, a clearance into which the wire 18 can move is formed between the first guide member 36 and the second guide member 37, as illustrated in FIG. 13. Then, the nozzle 51 is moved by the nozzle moving mechanism 52 (FIGS. 5 and 6) to move the wire 18 fed to pass through the nozzle 51 into the clearance between the first guide member 36 and the second guide member 37.

Next, the operation piece 31 and the pair of swinging pieces 22 and 23 are rotated by the first servomotor 14 and the second servomotor 27 (FIG. 5) to wind the wire 18 around the outer circumference of the cylindrical bobbin 19 held on the enlarged outer circumference of the distal end of the pair of swinging pieces 22 and 23. Specifically, the first servomotor 14 and the second servomotor 27 are driven in synchronization with each other to rotate both the operation piece 31 and the pair of swinging pieces 22 and 23 at the same rotation speed in the same direction to wind the wire 18. The winding start end 18*a* of the wire 18 fed to pass through the distal end of the nozzle 51 is guided into the clearance between the first guide member 36 and the second guide member 37 so that the wire 18 is wound around the outer circumference of the cylindrical bobbin 19 at a predetermined position in the axial direction.

A first layer of the non-circular coil 90 is formed as follows. Each time the cylindrical bobbin 19 rotates at 360 degrees, the pair of swinging pieces 22 and 23 is moved together with the first guide member 36 away from the operation piece 31 by driving the servomotor 43 of the insertion/removal mechanism 40, as indicated by the arrow in broken line in FIG. 14. In this manner, the clearance between the first guide member 36 and the second guide member 37 is increased by the amount equal to the diameter of the wire 18. As the first layer of the non-circular coil 90, the clearance between the first guide member 36 and the second guide member 37, in which the wire 18 is wound, is increased in accordance with the number of turns of the wire 18. In this manner, so-called regular winding for winding the wire 18 so as to form the turns of the wire 18 in close contact with each other is performed.

After the winding for the first layer on the outer circumference of the cylindrical bobbin 19 is terminated, the operation piece 31 and the pair of swinging pieces 22 and 23 are rotated to wind the wire 18 fed to pass through the nozzle 51 without changing the clearance between the first guide member 36 and the second guide member 37. In this manner, the winding for second and subsequent layers is performed. For the winding for the second and subsequent layers, by driving the nozzle moving mechanism 52 (FIG. 6), the nozzle 51 is moved in a reciprocating manner in the Y-axis direction within the range of the clearance between the first guide member 36 and the second guide member 37, as indicated by the arrow in solid line in FIG. 14. The wire 18 fed to pass through the nozzle 51 is wound over the first layer of the winding formed on the cylindrical bobbin 19 based on the regular winding. In this manner, the outer circumferential edge of the cylindrical bobbin 19 is moved into the first clearance 36*a* and the second clearance 37*a* to determine the position of the cylindrical bobbin 19 in the axial direction. By winding the wire 18 around the cylindrical bobbin 19 between the first guide member 36 and the second guide member 37 in this state, the non-circular coil 90 can be formed over a predetermined range of the cylindrical bobbin 19.

As illustrated in FIG. 3, in a state in which the operation piece 31 is inserted between the distal ends of the swinging pieces 22 and 23, both the side surfaces 31*d* and 31*e* which are not in contact with the swinging pieces 22 and 23 bulge outward to be curved, and are formed so as to be continuous with the outer circumference surfaces of the swinging pieces 22 and 23 around which the wire 18 is wound. Therefore, the outer circumferential surfaces of the swinging pieces 22 and 23 having the distance therebetween enlarged by the insertion of the operation piece 31, around which the wire 18 is wound, are connected by the side surfaces 31*d* and 31*e* of the operation piece 31 which bulge outward to be curved. Therefore, the sectional shape of the pair of swinging pieces 22 and 23, which is enlarged by the insertion of the operation piece 31, becomes a shape without a straight-line portion as a whole, for example, an ellipsoidal shape.

For the winding of the wire 18, the predetermined tension F is applied to the wire 18 by the tension device 53 (FIG. 6). Therefore, the wire 18 on which the tension F is applied is wound around the outer circumference of the pair of swinging pieces 22 and 23, which is enlarged by the insertion of the operation piece 31 (FIG. 3). Therefore, when the wire 18 is wound around the outer circumference of the pair of swinging pieces 22 and 23, which is enlarged by the insertion of the operation piece 31, the wire 18 is pressed not only against the enlarged outer circumference of the pair of swinging pieces 22 and 23 but also against the side surfaces 31*d* and 31*e* of the operation piece 31 which bulge outward to be curved, by the tension F applied to the wire 18 in the longitudinal direction.

Therefore, the wire 18 is prevented from being separated away from the cylindrical bobbin 19 supported by the pair of swinging pieces 22 and 23 to locally bulge. As a result, the wire 18 can be wound around the cylindrical bobbin 19 in close contact therewith.

After the wire 18 is wound around the cylindrical bobbin 19 to form a predetermined number of layers as illustrated in FIG. 14, the winding finish end 18*b* of the wire 18 fed to pass through the nozzle 51 is locked to the locking part 39, as illustrated in FIG. 15. In this manner, the wire 18 is wound around the cylindrical bobbin 19 to form the non-circular coil 90 around the cylindrical bobbin 19.

In the case where the insulating coating of the wire 18 is heated to be melted and is then cooled to be firmly fixed, the air nozzle 81*a* of the hot-air blower 81 illustrated in FIG. 5 is moved from the second position indicated by the solid line to the first position indicated by the alternate long and short dash line to blow a hot air to the non-circular coil 90 (FIG. 8) which is currently being formed or has already been formed. As a result, the insulating coating of the wire 18 is melt and is firmly fixed to bond the turns of the wire 18 to each other. At the same time, the non-circular coil 90 is bonded to the cylindrical bobbin 19. Therefore, an event in which the shape of the non-circular coil 90 formed by the regular winding is subsequently deformed can be prevented. After the formation of the non-circular coil 90, the air nozzle 81*a* is returned from the first position to the second position.

(Reducing Step)

In the reducing step, the distance between the distal ends of the swinging pieces 22 and 23 around which the non-circular coil 90 is formed is reduced, as illustrated in FIG. 15. The distance between the distal ends is reduced by removing the operation piece 31 from between the swinging pieces 22 and 23. Specifically, by driving the servomotor 43 of the insertion/removal mechanism 40 illustrated in FIG. 5, the pair of swinging pieces 22 and 23 is moved away from the operation piece 31 to remove the operation piece 31 from between the swinging pieces 22 and 23. When the operation piece 31 is removed from between the swinging pieces 22 and 23, the distance between the distal ends of the swinging pieces 22 and 23 is reduced by the biasing force of the coil spring 29.

(Coil-Removing Step)

In the coil-removing step, the non-circular coil 90 is removed from the reduced outer circumference of the distal end of the pair of swinging pieces 22 and 23. In this embodiment, the non-circular coil 90 is removed together with the cylindrical bobbin 19. Specifically, by driving the servomotor 72 of the pull-out mechanism 70 illustrated in FIG. 7, the core 24 is moved in the Y-axis direction through an intermediation of the retaining member 76 to pull the pair of swinging pieces 22 and 23 into the interior of the first guide member 36, as illustrated in FIG. 16. At this time, the end of the cylindrical bobbin 19 is locked to the first clearance 36*a* of the first guide member 36 to restrict the movement thereof. Therefore, the pair of swinging pieces 22 and 23 is removed from the cylindrical bobbin 19. In this manner, the non-circular coil 90 is removed together with the cylindrical bobbin 19 locked to the first guide member 36 from the pair of swinging pieces 22 and 23.

With the removal of the non-circular coil 90, the operation button 38*a* of the gripper 38 is operated by the operation device (not shown) to release, from the gripper 38, the winding start end 18*a* of the wire 18 gripped by the gripper 38. At the same time, the winding finish end 18*b* of the wire 18 locked to the locking part 39 is gripped by the gripping device 60 (FIG. 6). Then, the wire 18 between the nozzle 51 and the locking part 39 is cut by the cutter device 59. In the above-mentioned manner, the non-circular coil 90 formed by winding the wire 18 around the cylindrical bobbin 19 is obtained.

In this embodiment, the obtained non-circular coil 90 has an ellipsoidal shape. Therefore, the wire 18 does not have a straight-line portion. When the non-circular coil having an oval or square shape is to be manufactured, a wire straightening step of changing the shape of the non-circular coil 90 is further required. In the wire straightening step, the parts of the wire 18 of the non-circular coil 90 removed from the swinging pieces 22 and 23, which are curved and wound in contact with the side surfaces 31*d* and 31*e* of the operation piece 31, are straightened to provide straight-line portions to the non-circular coil 90. In the following, the case where the wire straightening step is performed by using the wire shaping device 100 is described.

As illustrated in FIG. 17, the non-circular coil 90 is placed on the placement piece 102. Then, as illustrated in FIG. 18, the opposing curved portions 90*a* (FIG. 8A) which are formed in the non-circular coil 90 are sandwiched between the pair of pressing members 103 to be pressed therebetween for straightening. At the same time, the extension of the non-circular coil 90 in a direction perpendicular to a direction in which the non-circular coil 90 is sandwiched is restricted by the pair of support members 113 to prevent the size of the non-circular coil 90 from being increased in the longitudinal direction. Specifically, the non-circular coil 90 having the ellipsoidal shape is sandwiched and pressed between the pair of pressing members 103 from both sides in the short-diameter direction. In this manner, the parts of the wire 18, which are curved and wound in contact with the side surfaces 31*d* and 31*e* of the operation piece 31, are straightened, while the extension of the wire 18 in the long-diameter direction is restricted by the pair of support members 113. In this manner, the non-circular coil 90 having an oval shape is obtained.

Figure 8B:
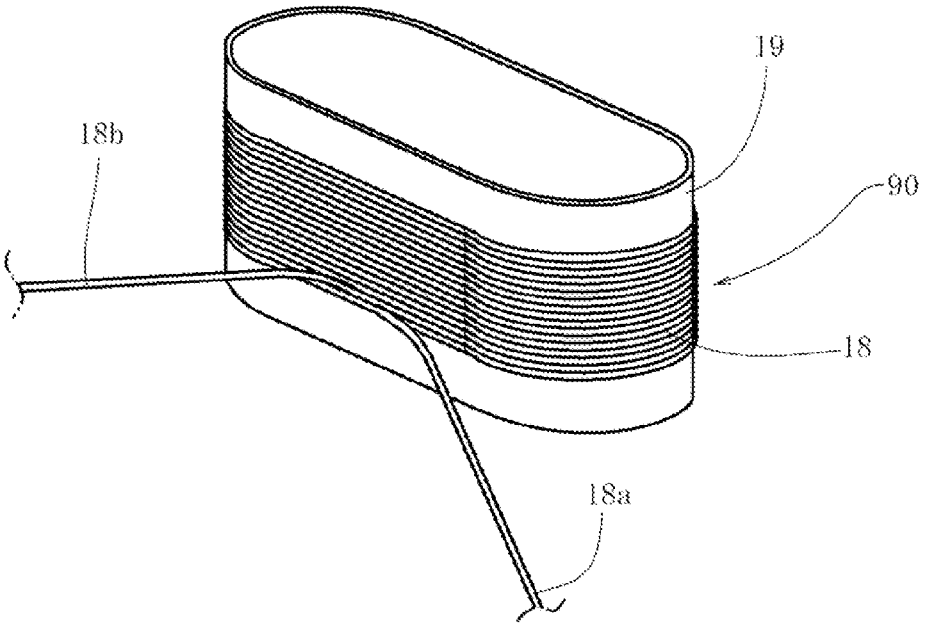
FIG. 8B is a perspective view of the non-circular coil obtained by winding the wire around the cylindrical bobbin in a case where the non-circular coil has an oval sectional shape.

In the case where the insulating coating of the wire 18 is heated to be melted and is then cooled to be firmly fixed, a hot air is blown to the non-circular coil 90 having the oval shape, which is currently being formed or has already been formed. As a result, the insulating coating of the wire 18 is melted and firmly fixed to bond the turns of the wire 18 to each other. Therefore, an event in which the oval shape of the non-circular coil 90 illustrated in FIG. 8B is subsequently deformed can be prevented.

The non-circular coil 90 without a straight-line portion is first manufactured as illustrated in FIG. 8A, and then the corresponding portions of the wire 18 are straightened. As a result, the non-circular coil 90 having the oval or square shape with the straight-line portions as illustrated in FIG. 8B can be manufactured. Even in this case, for example, the wire 18 wound while being pressed against the side surfaces 31*d* and 31*e* of the operation piece 31, which bulge outward to be curved, is wound around the cylindrical bobbin 19 without bulging. Therefore, the straight-line portions of the non-circular coil 90 having the oval or square shape obtained by shaping the parts of the wire 18 into the straight-line portions do not bulge. Therefore, according to this embodiment, even when the non-circular coil 90 with the straight-line portions having the shape such as an oval or square shape is to be obtained, the wire 18 to be wound can be prevented from bulging.

According to this embodiment described above, the following functions and effects are obtained.

In a state in which the operation piece 31 is inserted between the distal ends of the swinging pieces 22 and 23, the side surfaces 31*d* and 31*e*, which are not in contact with the swinging pieces 22 and 23, bulge outward to be curved and are formed continuous with the outer circumferential surfaces of the swinging pieces 22 and 23 around which the wire 18 is wound. Therefore, the outer circumferential surfaces of the swinging pieces 22 and 23 having the distance therebetween enlarged by the insertion of the operation piece 31, around which the wire 18 is wounded, are connected by the side surfaces 31*d* and 31*e* of the operation piece 31 which bulge outward to be curved. Therefore, the sectional shape of the pair of swinging pieces 22 and 23 having the distance between the distal ends, which is enlarged by the insertion of the operation piece 31, becomes a shape without a straight-line portion as a whole, for example, an ellipsoidal shape. When the wire 18 is wound around the outer circumference of the pair of swinging pieces 22 and 23 having the distance therebetween enlarged by the insertion of the operation piece 31, due to the predetermined tension applied in the longitudinal direction of the wire 18, the wire 18 is pressed against the outer circumference of the pair of swinging pieces 22 and 23 having the increased distance therebetween and the side surfaces 31*d* and 31*e* of the operation piece 31 which bulge outward to be curved. Therefore, when the wire 18 is wound, the wire 18 is prevented from separating way from the outer circumference of the pair of swinging pieces 22 and 23 and the side surfaces 31*d* and 31*e* of the operation piece 31 to bulge.

The non-circular coil 90, which is obtained by winding the wire 18 around the outer circumference of the pair of swinging pieces 22 and 23 having the distance therebetween enlarged by the insertion of the operation piece 31, has a shape without a straight-line portion, such as an ellipsoidal shape. When a non-circular coil having an oval or square shape is to be manufactured, however, the shape of the non-circular coil 90 having a shape such as an ellipsoidal shape is changed to obtain the non-circular coil with straight-line portions having a shape such as an oval or square shape. Even in this case, for example, the wire 18 wound while being pressed against the side surfaces 31*d* and 31*e* of the operation piece 31, which bulge outward to be curved, does not bulge. Therefore, the straight-line portions of the non-circular coil 90 having an oval or square shape obtained by subsequently changing the parts of the wire 18 into the straight-line portions do not bulge. Therefore, according to this embodiment, even when the non-circular coil 90 with the straight-line portions having a shape such as an oval or square shape is to be obtained, the wire 18 to be wound can be prevented from bulging.

When the wire 18 is wound, the wire 18 is wound around the outer circumference of the pair of swinging pieces 22 and 23 under the predetermined tension applied by the tension device 53. However, when the non-circular coil 90 formed around the pair of swinging pieces 22 and 23 is removed from the pair of swinging pieces 22 and 23, the distance between the distal ends of the swinging pieces 22 and 23, around which the wire 18 is wound, is reduced as illustrated in FIG. 15. Therefore, the clearance is generated between the outer circumference of the distal end of the pair of swinging pieces 22 and 23 and an inner circumference of the cylindrical bobbin 19. Thus, the outer circumference of the distal end of the pair of swinging pieces 22 and 23 and the inner circumference of the cylindrical bobbin 19 are prevented from significantly slide against each other. Accordingly, the non-circular coil 90 can be relatively easily removed from the pair of swinging pieces 22 and 23 without damaging the coating of the wire 18.

The wire 18 is wound around the cylindrical bobbin 19 in a state in which the outer circumference edge of the cylindrical bobbin 19 on the one side moves into the first clearance 36*a* between the first guide member 36 and the pair of swinging pieces 22 and 23 and the outer circumference edge of the cylindrical bobbin 19 on the another side moves into the second clearance 37*a* between the second guide member 37 and the pair of swinging pieces 22 and 23. Therefore, the wire 18 can be wound over the desired range of the cylindrical bobbin 19.

The non-circular coil 90 is removed from the pair of swinging pieces 22 and 23 by pulling the pair of swinging pieces 22 and 23 into the interior of the first guide member 36 in a state in which the movement of the cylindrical bobbin 19 is restricted by the first guide member 36. Therefore, the non-circular coil 90 can be easily removed from the pair of swinging pieces 22 and 23.

In the following, variations of the embodiment described above are described.

In the embodiment described above, the case where the non-circular coil 90 is formed around the cylindrical bobbin 19 has been described. However, the wire 18 may be directly wound around the pair of swinging pieces 22 and 23 without using the cylindrical bobbin 19 to form the non-circular coil 90 on the outer circumference of the pair of swinging pieces 22 and 23. Even without using the cylindrical bobbin 19, the distance between the distal ends of the swinging pieces 22 and 23, around which the wire 18 is wound, is reduced when the non-circular coil 90 formed by winding the wire 18 around the pair of swinging pieces 22 and 23 is removed from the pair of swinging pieces 22 and 23. Therefore, the clearance is generated between the outer circumference of the distal end of the pair of swinging pieces 22 and 23 and the inner circumference of the non-circular coil 90. Thus, the surface coating on the inner circumference of the non-circular coil 90 and the outer circumference of the distal end of the pair of swinging pieces 22 and 23 are prevented from significantly slide against each other. Accordingly, even when the non-circular coil 90 is formed directly on the outer circumference of the pair of swinging pieces 22 and 23, the non-circular coil 90 can be relatively easily removed from the pair of swinging pieces 22 and 23 without damaging the coating of the wire 18.

In the embodiment described above, the case where the sectional shape of the pair of swinging pieces 22 and 23 having the increased distance between the distal ends by the insertion of the operation piece 31 is ellipsoidal and the obtained non-circular coil 90 has the ellipsoidal shape has been described. However, the sectional shape of the pair of swinging pieces 22 and 23 having the increased distance by the insertion of the operation piece 31 may be any shape as long as the side surfaces 31*d* and 31*e* of the operation piece 31 inserted between the distal ends of the swinging pieces 22 and 23 bulge outward to be curved and are formed so as to be continuous with the outer circumferential surfaces of the swinging pieces 22 and 23 so that the sectional shape does not have a straight-line portion as a whole. For example, the sectional shape of the pair of swinging pieces 22 and 23 may be a rounded square.

In the embodiment described above, the case where the insertion/removal mechanism 40 for moving the pair of swinging pieces 22 and 23 together with the first rotary body 26 so that the operation piece 31 is inserted and removed from between the distal ends of the swinging pieces 22 and 23 has been described. However, the insertion/removal mechanism 40 may have any configuration as long as the operation piece 31 is inserted and removed from between the distal ends of the swinging pieces 22 and 23. For example, the insertion/removal mechanism 40 may have a configuration for moving the operation piece 31 in the axial direction.

Embodiments of this invention were described above, but the above embodiments are merely examples of applications of this invention, and the technical scope of this invention is not limited to the specific constitutions of the above embodiments.

This application claims priority based on Japanese Patent Application No. 2012-142758 filed with the Japan Patent Office on Jun. 26, 2012, the entire contents of which are incorporated into this specification.

What is claimed is:

1. An apparatus for manufacturing a non-circular coil, comprising:

a pair of swinging pieces having base ends and distal ends, the base ends being supported swingably, the distal ends being configured to increase and reduce a distance between the distal ends;

an operation piece configured to be inserted and removed from between the distal ends of the pair of swinging pieces to respectively increase and reduce the distance between the distal ends of the pair of swinging pieces; and a winding mechanism for winding a wire around outer circumferences of the distal ends of the pair of swinging pieces, when the distance between the distal ends is being enlarged by the insertion of the operation piece, so as to form a non-circular coil, wherein side surfaces of the operation piece, which avoid contact with the pair of swinging pieces, bulge outward to be curved and are formed so as to be continuous with outer circumferential surfaces of the pair of swinging pieces when the wire is wound around the pair of swinging pieces, in a state in which the operation piece is inserted between the distal ends of the pair of swinging pieces.

2. An apparatus for manufacturing a non-circular coil according to claim 1, further comprising:

a first guide member into which the base ends of the pair of swinging pieces are inserted, for restricting one side of a winding width of the wire to be wound around the distal ends of the pair of swinging pieces; and a second guide member into which the distal ends of the pair of swinging pieces are removably inserted, for restricting another side of the winding width of the wire to be wound around the distal ends of the pair of swinging pieces.

3. An apparatus for manufacturing a non-circular coil according to claim 2, further comprising:

a cylindrical bobbin mounted to the distal ends of the pair of swinging pieces, around which the wire is wound, wherein the first guide member and the pair of swinging pieces form therebetween a first clearance into which an outer circumferential edge of the cylindrical bobbin on one side moves, and the second guide member and the pair of swinging pieces form therebetween a second clearance into which the outer circumferential edge of the cylindrical bobbin on another side moves.

4. An apparatus for manufacturing a non-circular coil according to claim 3, further comprising:

a pull-out mechanism for pulling out the pair of swinging pieces from the first guide member.

5. An apparatus for manufacturing a non-circular coil according to claim 1, further comprising:

a wire shaping device for straightening the wire curved to be wound in contact with the side surfaces of the operation piece, wherein the wire shaping device comprises:

a placement piece on which the non-circular coil is to be placed, the non-circular coil being obtained by winding the wire around the outer circumferences of the distal ends of the pair of swinging pieces having the enlarged distance therebetween;

a pair of pressing members for sandwiching and pressing curved portions of the non-circular coil from both sides thereof;

pressing-member moving actuators for reducing a distance between the pair of pressing members;

a pair of support members for sandwiching and holding the non-circular coil in a direction perpendicular to a direction in which the pair of pressing members sandwich the non-circular coil therebetween; and support-member moving actuators for reducing a distance between the pair of support members.

6. An apparatus for manufacturing a non-circular coil according to claim 5, wherein the non-circular coil has an ellipsoidal shape, and the placement piece is provided so that the pair of pressing members are located in a short-diameter direction of the non-circular coil and the pair of support members are located in a long-diameter direction of the non-circular coil.

7. A method of manufacturing a non-circular coil, comprising:

an enlarging step of inserting an operation piece between distal ends of a pair of swinging pieces having base ends supported swingably and the distal ends with a distance therebetween being increasable or reducible so as to enlarge the distance between the distal ends of the pair of swinging pieces;

a winding step of winding a wire around outer circumferences of the distal ends of the pair of swinging pieces with the distance therebetween being enlarged by the insertion of the operation piece so as to form a non-circular coil;

a reducing step of pulling out the operation piece from between the pair of swinging pieces to reduce the distance between the distal ends of the pair of swinging pieces, around which the non-circular coil is formed; and a coil-removing step of removing the non-circular coil from the reduced outer circumferences of the distal ends of the pair of swinging pieces, wherein side surfaces of the operation piece, which avoid contact with the pair of swinging pieces, bulge outward to be curved and are formed so as to be continuous with outer circumferential surfaces of the pair of swinging pieces, around which the wire is wound, in a state in which the operation piece is inserted between the distal ends of the pair of swinging pieces.

8. A method of manufacturing a non-circular coil according to claim 7, wherein the winding step comprises restricting a winding width of the wire wound around the outer circumferences of the distal ends of the pair of swinging pieces between a first guide member into which the base ends of the pair of swinging pieces are inserted and a second guide member into which the distal ends of the pair of swinging pieces are removably inserted.

9. A method of manufacturing a non-circular coil according to claim 8, further comprising:

a bobbin-mounting step of mounting a cylindrical bobbin to the distal ends of the pair of swinging pieces prior to the enlarging step, wherein the enlarging step comprises moving an outer circumferential edge of the cylindrical bobbin on one side into a first clearance between the first guide member and the pair of swinging pieces and moving the outer circumferential edge of the cylindrical bobbin on another side into a second clearance between the second guide member and the pair of swinging pieces, and the winding step comprises winding the wire around an outer circumference of the cylindrical bobbin between the first guide member and the second guide member.

10. A method of manufacturing a non-circular coil according to claim 9, wherein the coil-removing step comprises pulling the pair of swinging pieces into an interior of the first guide member to remove the non-circular coil together with the cylindrical bobbin locked to the first guide member from the pair of swinging pieces.

11. A method of manufacturing a non-circular coil according to claim 7, further comprising:

a wire straightening step of straightening parts of the wire of the non-circular coil removed from the pair of swinging pieces, which are curved to be wound in contact with the side surfaces of the operation piece, wherein the wire straightening step comprises:

sandwiching and pressing curved portions of the non-circular coil from both sides thereof, and restricting extension of the non-circular coil in a direction perpendicular to a direction in which the non-circular coil is sandwiched and pressed.

12. A method of manufacturing a non-circular coil according to claim 11, wherein the non-circular coil removed from the pair of swinging pieces has an ellipsoidal shape, and the wire straightening step comprises sandwiching and pressing the non-circular coil from both sides in a short-diameter direction to straighten the wire curved to be wound in contact with the side surfaces of the operation piece, and restricting extension of the non-circular coil in a long-diameter direction to obtain a non-circular coil having an oval shape.

* * * * *